US011674372B2

(12) United States Patent
Dumont et al.

(10) Patent No.: US 11,674,372 B2
(45) Date of Patent: Jun. 13, 2023

(54) GEOLOGIC FORMATION CHARACTERIZATION VIA FLUID SEPARATION

(71) Applicant: Schlumberger Technology Corporation, Sugar Land, TX (US)

(72) Inventors: Hadrien Dumont, Paris (FR); Francois Xavier Dubost, Ciudad del Carmen (MX); Bertrand Claude Theuveny, Paris (FR); Adriaan Gisolf, Bucharest (RO); Pierre-Yves Corre, Abbeville (FR)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 40 days.

(21) Appl. No.: 17/207,871

(22) Filed: Mar. 22, 2021

(65) Prior Publication Data

US 2021/0293122 A1 Sep. 23, 2021

Related U.S. Application Data

(60) Provisional application No. 62/992,801, filed on Mar. 20, 2020.

(51) Int. Cl.
*E21B 49/08* (2006.01)
*E21B 43/12* (2006.01)

(52) U.S. Cl.
CPC ..... *E21B 43/121* (2013.01); *E21B 49/087* (2013.01); *E21B 49/088* (2013.01)

(58) Field of Classification Search
CPC ..... E21B 49/088; E21B 49/08
See application file for complete search history.

(56) References Cited

U.S. PATENT DOCUMENTS

| | | | | |
|---|---|---|---|---|
| 10,107,096 | B2 * | 10/2018 | Bedouet | E21B 49/005 |
| 2007/0044960 | A1 * | 3/2007 | Lovell | E21B 43/122 166/250.07 |
| 2013/0084194 | A1 * | 4/2013 | Falk | F04F 5/48 417/151 |

* cited by examiner

*Primary Examiner* — Giovanna Wright
(74) *Attorney, Agent, or Firm* — Michael L. Flynn

(57) ABSTRACT

A method can include flowing fluid from a formation from an inlet of a tool to an annulus; flowing spacer fluid from a conduit to the annulus; flowing the fluid and the spacer fluid in the annulus to a station; and collecting the fluid.

20 Claims, 12 Drawing Sheets

GEOLOGIC FORMATION CHARACTERIZATION VIA FLUID SEPARATION

RELATED APPLICATIONS

This application claims priority to and the benefit of a U.S. Provisional Application having Ser. No. 62/992,801, filed 20 Mar. 2020, which is incorporated by reference herein.

BACKGROUND

Various types of equipment can be utilized to characterize a formation, which can include characterizing the formation as to its structural aspects and its physical properties. Where a formation includes one or more hydrocarbon reservoirs, operations and equipment can be selected and utilized according to a characterization of the formation for production of hydrocarbons. Characterization can facilitate simulation of operations, equipment performance, fluid flow, etc. For example, a digital representation of a formation can be constructed using sensor data acquired through performance of one or more characterization processes. For example, consider a characterization process that can drive fluid in a formation and acquire sensor data as to flow of fluid, directly and/or indirectly. In such an example, pressure can be utilized to drive fluid in a formation where a response thereto may depend on one or more pressures (e.g., formation pressure(s), etc.). Sensor data acquired during one or more operations may be utilized to determine a quantity and/or quality of formation fluids such as liquid and/or gas hydrocarbons, condensates, drilling muds, fluid contacts, and so forth.

SUMMARY

A method can include flowing fluid from a formation from an inlet of a tool to an annulus; flowing spacer fluid from a conduit to the annulus; flowing the fluid and the spacer fluid in the annulus to a station; and collecting the fluid. A system can include a tool operatively coupled to a cable that includes a packer, a fluid inlet, a fluid outlet, a pump, at least one power conductor and at least one data conductor; a blowout preventer that includes a bypass line coupling in fluid communication with an annulus; a bypass line attached to the bypass line coupling and in fluid communication with the annulus and a station; a spacer fluid pump in fluid communication with a conduit, where an opening of the conduit is in fluid communication with an opening of the annulus; and a system controller that includes processor-executable instructions executable by a processor to: instruct the spacer fluid pump to pump spacer fluid to the conduit, instruct the tool to flow formation fluid, where at least a portion of the spacer fluid and at least a portion of the formation fluid flow sequentially to the annulus, from the annulus to the bypass line and from the bypass line to the station, and instruct the station to collect a volume of the formation fluid. One or more computer-readable storage media can include processor-executable instructions, executable to instruct a system to: flow fluid from a formation from an inlet of a tool to an annulus; flow spacer fluid from a conduit to the annulus; flow the fluid and the spacer fluid in the annulus to a station; and collect the fluid.

This summary is provided to introduce a selection of concepts that are further described below in the detailed description. This summary is not intended to identify key or essential features of the claimed subject matter, nor is it intended to be used as an aid in limiting the scope of the claimed subject matter.

BRIEF DESCRIPTION OF THE DRAWINGS

Features and advantages of the described implementations can be more readily understood by reference to the following description taken in conjunction with the accompanying drawings.

DETAILED DESCRIPTION

The following description includes the best mode presently contemplated for practicing the described implementations. This description is not to be taken in a limiting sense, but rather is made merely for the purpose of describing the general principles of the implementations. The scope of the described implementations should be ascertained with reference to the issued claims.

Formation testing provides information about the properties of a subsurface formation such as the minimum horizontal stress, which may be useful for optimizing the extraction of oil and gas from a subsurface formation. During formation testing, a downhole tool is inserted into a wellbore and formation fluid is withdrawn from the subsurface formation. The subsurface formations are accessed by wells drilled with a wellbore fluid (e.g., drilling fluid or mud filtrate). Part of the wellbore fluid may displace a portion of formation fluid around the wellbore in permeable rock formations. During operation, the formation fluid may contaminate the wellbore fluid, rendering the wellbore fluid unusable on future operations.

Accordingly, the present disclosure provides an efficient solution to isolate formation fluid from the wellbore fluid, and use the wellbore fluid to displace the isolated formation fluid and return it to the surface. Aspects in accordance with the present disclosure may be applied to, for example, cases where large amounts of formation fluid need to be collected at the surface without contaminating the wellbore fluid circulated in the wellbore. Embodiments of the present disclosure may include downhole tools with a circulation assembly, where at least one spacer is introduced to buffer the formation fluid from the wellbore fluid.

Figure 1:
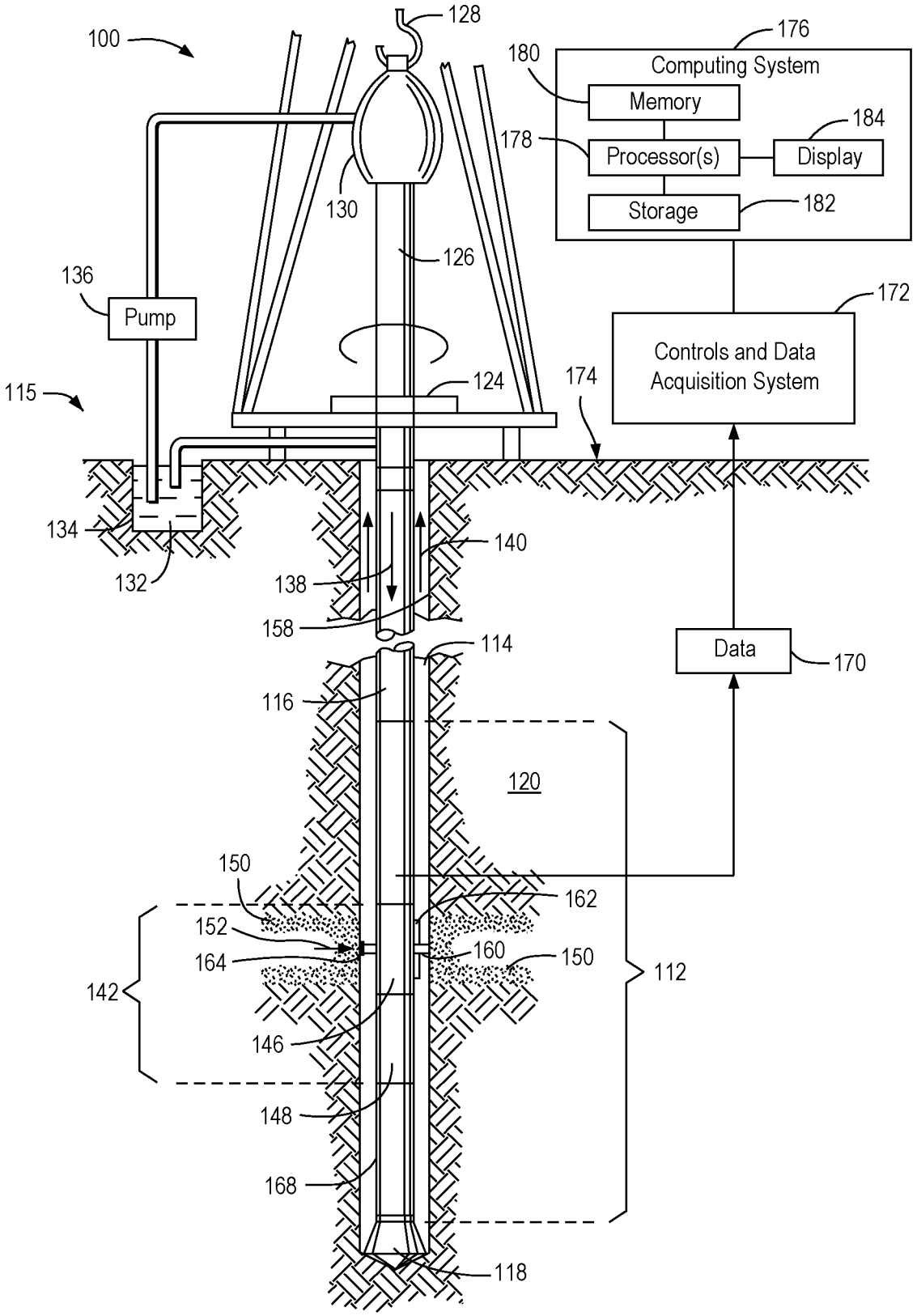
FIG. 1 is a schematic diagram of an example of a wellsite system that may employ downhole fluid analysis for determining fluid properties of a reservoir, in accordance with an embodiment.
Figure 2:
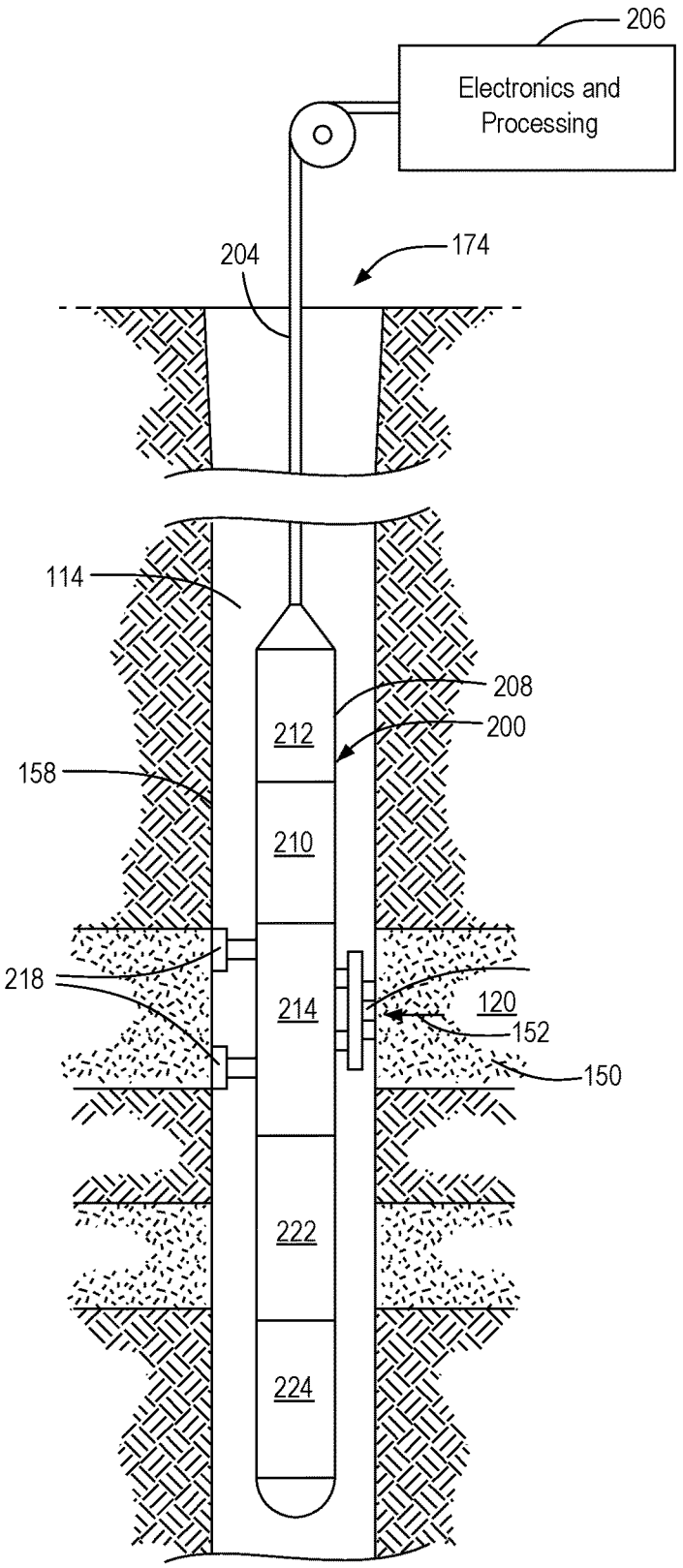
FIG. 2 is a schematic diagram of an example of a wellsite system that may employ downhole fluid analysis methods for determining fluid properties and formation characteristics within a wellbore, in accordance with an embodiment.

With the foregoing in mind, FIGS. 1 and 2 depict examples of wellsite systems that may employ the formation tester and techniques described herein. FIG. 1 depicts a rig 100 with a downhole tool 112 suspended therefrom and into a wellbore 114 of a reservoir 150 via a drillstring 116. The downhole tool 112 has a drill bit 118 at its lower end thereof that is used to advance the downhole tool 112 into geological formation 120 and form the wellbore 114. The drillstring 116 is rotated by a rotary table 124, energized by means not shown, which engages a kelly 126 at the upper end of the drillstring 116. The drillstring 116 is suspended from a hook 128, attached to a traveling block (also not shown), through the kelly 126 and a rotary swivel 130 that permits rotation of the drillstring 116 relative to the hook 128. The rig 100 is depicted as a land-based platform and derrick assembly used to form the wellbore 114 by rotary drilling. However, in other embodiments, the rig 100 may be an offshore platform.

Wellbore fluid or mud 132 (e.g., oil-base mud (OBM), which can include synthetic oil-base mud (SOBM), or water-base mud (WBM)) is stored in a pit 134 formed at the well site. A pump 136 delivers the wellbore fluid 132 to the interior of the drillstring 116 via a port in the swivel 130, inducing the wellbore fluid 132 to flow downwardly through the drillstring 116 as indicated by a directional arrow 138. In the example of FIG. 1, the wellbore fluid can exit the drillstring 116 via ports in the drill bit 118, and then circulate upwardly through the region between the outside of the drillstring 116 and the wall of the wellbore 114, which may be referred to as an annulus, as indicated by directional arrows 140. The wellbore fluid 132 can lubricate the drill bit 118 and carry formation cuttings up to the surface as the wellbore fluid 132 is returned to the pit 134 for recirculation.

The downhole tool 112, which may be a bottom hole assembly ("BHA"), may be positioned near the drill bit 118 and can include various components with capabilities, such as measuring, processing, and storing information, as well as communicating with the surface. A telemetry device (not shown) also may be provided for communicating with a surface unit (not shown). As should be noted, the downhole tool 112 may be conveyed on wired drillpipe, a combination of wired drillpipe and wireline, or other suitable types of conveyance.

In certain embodiments, the downhole tool 112 includes a downhole analysis system. For example, the downhole tool 112 may include a sampling system 142 including a fluid communication unit 146 and a sampling unit 148. The units may be housed in a drill collar or other type of collar for performing various formation evaluation functions, such as pressure testing and fluid sampling, among others. As shown in FIG. 1, the fluid communication unit 146 is positioned adjacent the sampling unit 148; however the position of the fluid communication unit 146, as well as one or more other units, may vary in other embodiments. Additional devices, such as pumps, gauges, sensor, monitors, pumps, or other devices usable in downhole sampling and/or testing also may be provided. The additional devices may be incorporated into one or more of the units 146 and 148 or disposed within one or more separate units, which may be included within the sampling system 142.

The downhole tool 112 may evaluate fluid properties of reservoir fluid 150. Accordingly, the sampling system 142 may include sensors that may measure fluid properties such as gas-to-oil ratio (GOR), mass density, optical density (OD), composition of carbon dioxide ($CO_2$), $C_1$, $C_2$, $C_3$, $C_4$, $C_5$, and $C_{6+}$, formation volume factor, viscosity, resistivity, fluorescence, American Petroleum Institute (API) gravity, and combinations thereof of the formation fluid 150. The fluid communication unit 146 includes a probe 160, which may be positioned in a stabilizer blade or rib 162. The probe 160 includes one or more inlets for receiving a portion 152 of the formation fluid 150 and one or more flowlines (not shown) extending into the downhole tool 112 for passing fluids (e.g., the formation fluid 150) through the tool. In certain embodiments, the probe 160 may include a single inlet designed to direct the formation fluid 150 into a flowline within the downhole acquisition tool 112. Further, in other embodiments, the probe 160 may include multiple inlets that may, for example, be used for focused sampling. In these embodiments, the probe 160 may be connected to a sampling flowline, as well as to guard flowlines. The probe 160 may be movable between extended and retracted positions for selectively engaging the wellbore wall 158 of the wellbore 114 and acquiring fluid samples from the geological formation 120. One or more setting pistons 164 may be provided to assist in positioning the fluid communication device against the wellbore wall 158.

In certain embodiments, the downhole tool 112 includes a logging while drilling (LWD) unit 168. Such a LWD unit 168 can include a radiation source that emits radiation (e.g., gamma rays) into the formation 120 to determine formation properties such as, e.g., lithology, density, formation geometry, reservoir boundaries, among others. The gamma rays interact with the formation through Compton scattering, which may attenuate the gamma rays. Sensors within the unit 168 may detect the scattered gamma rays and determine the geological characteristics of the formation 120 based at least in part on the attenuated gamma rays.

The sensors within the downhole tool 112 may collect and transmit data 170 (e.g., log and/or DFA data) associated with the characteristics of the formation 120 and/or the fluid properties and the composition of the reservoir fluid 150 to a control and data acquisition system 172 at surface 174, where the data 170 may be stored and processed via a computing system 176, which may be a local and/or a remote part of the control and data acquisition system 172.

The computing system 176 may include one or more processors 178, memory 180, storage 182, and/or a display 184. The memory 180 may include one or more tangible, non-transitory, machine readable media collectively storing one or more sets of instructions for operating the downhole tool 112, determining formation characteristics (e.g., geometry, connectivity, minimum horizontal stress, etc.) calculating and estimating fluid properties of the reservoir fluid 150, modeling the fluid behaviors using, e.g., equation of state models (EOS). The memory 180 may store reservoir modeling systems (e.g., geological process models, petroleum systems models, reservoir dynamics models, etc.), mixing rules and models associated with compositional characteristics of the formation fluid 150, equation of state (EOS) models for equilibrium and dynamic fluid behaviors (e.g., biodegradation, gas/condensate charge into oil, $CO_2$ charge into oil, fault block migration/subsidence, convective currents, among others), and any other information that may be used to determine geological and fluid characteristics of the formation 120 and formation fluid portion 152, respectively. In certain embodiments, the computing system 176 may apply filters to remove noise from the data 170.

To process the data 170, the processor 178 may execute instructions stored in the memory 180 and/or storage 182. For example, the instructions may cause the processor to compare the data 170 (e.g., from the logging while drilling and/or downhole analysis) with known reservoir properties estimated using the reservoir modeling systems, use the data 170 as inputs for the reservoir modeling systems, and identify geological and reservoir fluid parameters that may be used for exploration and production of the reservoir. As such, the memory 180 and/or storage 182 of the data processing system 176 may be a suitable article of manufacture that can store the instructions. By way of example, the memory 180 and/or the storage 182 may be ROM memory, random-access memory (RAM), flash memory, an optical storage medium, or a hard disk drive. The display 184 may be a suitable electronic display that can display information (e.g., logs, tables, cross-plots, reservoir maps, etc.) relating to properties of the well/reservoir as measured by the downhole tool 112. It should be appreciated that, although the computing system 176 is shown by way of example as being located at the surface 174, the computing system 176 may be located in the downhole tool 112 (e.g., at least in part within the downhole tool 112, etc.). In such embodiments, some of the data 170 may be processed and stored downhole (e.g., within the wellbore 114), while some of the data 170 may be sent to the surface 174 (e.g., in real time). In certain embodiments, the computing system 176 may use information obtained from petroleum system modeling operations, ad hoc assertions from the operator, empirical historical data (e.g., case study reservoir data) in combination with or lieu of the data 170 to determine certain parameters of a reservoir.

FIG. 2 depicts an example of a wireline downhole tool 200 that may employ one or more of the examples of systems, techniques, etc., described herein to minimize contamination of the wellbore fluid when flowing one or more volumes of formation fluid 150. The wireline downhole tool 200 is suspended in the wellbore 114 from the lower end of a multi-conductor cable 204 that is spooled on a winch at the surface 174. Similar to the downhole tool 112 of FIG. 1, the wireline downhole tool 200 may be conveyed on wired drillpipe, a combination of wired drillpipe and wireline, or other suitable types of conveyance.

As an example, coiled tubing may be utilized. Coiled tubing can be a relatively long, continuous length of flexible conduit wound on a spool. Such tubing can be straightened prior to pushing into the wellbore 114 and may be rewound to coil the tubing back onto the spool for transport, storage, etc. Depending on the tubing diameter (e.g., from a couple of centimeters to 10 centimeters or more) and the spool size, coiled tubing can range in length from approximately 100 meters to 5,000 meters or more.

In the example of FIG. 2, the cable 204 can be a wireline; noting that various components may provide for integrity of the cable 204, for example, to support its mass, to protect against contact with one or more other components (e.g., a borewall, fluid, debris, cuttings, etc.), etc. As an example, the cable can include one or more electrically conductive wires that can include one or more conductors and electrical insulation. As an example, a cable may include armor (e.g., as an outer layer). As an example, coiled tubing may be a cable and/or operate as a cable where conductive wire can be threaded through the lumen of the coiled tubing and/or otherwise carried by the coiled tubing (e.g., strapped about its exterior, etc.). As an example, coiled tubing can act as a conduit for flow of one or more fluids, which may include solids and/or other material.

In the example of FIG. 2, the cable 204 is communicatively coupled to an electronics and processing system 206. The wireline downhole tool 200 includes an elongated body 208 that houses units 210, 212, 214, 222, and 224 that provide various functionalities such as, for example, one or more of imaging, fluid sampling, fluid testing, operational control, and communication, among others. For example, the units 210 and 212 may provide functionality such as fluid analysis, resistivity measurements, operational control, communications, coring, and/or imaging, among others.

As shown in FIG. 2, the unit 214 is a fluid communication unit 214 that has a selectively extendable probe 216 and backup pistons 218 that are arranged on opposite sides of the elongated body 208. The extendable probe 216 is configured to selectively seal off or isolate selected portions of the wall 158 of the wellbore 114 to fluidly couple to the adjacent geological formation 120 and/or to draw fluid samples from the geological formation 120 (e.g., formation fluid, filtrate, etc.). The extendable probe 216 may include a single inlet or multiple inlets designed for guarded or focused sampling. The formation fluid 150, which can be or include reservoir fluid, may be expelled to the wellbore 114 through a port in the body 208 or the formation fluid 150 may be sent to one or more of the units 222 and 224. The units 222 and 224 may include one or more sample chambers that can store sampled fluid. In the illustrated example, the electronics and processing system 206 and/or a downhole control system can include various features to control the extendable probe 216 and/or the drawing of a fluid sample from the formation 120, for example, to enable analysis of the fluid properties of the sampled fluid (e.g., downhole, at surface, etc.).

In some embodiments, the unit 214 may be used for formation testing. For example, one or more of the extendable probes 216 may be used to pump fluid from the formation 120, measure and/or take samples of the fluid after the pumped fluid becomes sufficiently clean (e.g., drilling fluid contamination level below a threshold). In various instances, the one or more of the extendable probes 216 may be used to inject a fluid into the geological formation 120, for example, consider injection with sufficient pressure such that a fracture forms in the formation 120. In such an example, after a fracture forms, resulting in the release of flowback fluid or formation fluid 152 from the formation, one or more of the extendable probes 216 receive the fluid. The extendable probes 216 receiving the fluid may be coupled to one or more of the formation testing units 122 and/or 124, which can provide for determining one or more properties of the formation (e.g., based on sampled fluid, pressure, temperature, etc.).

Figure 3:
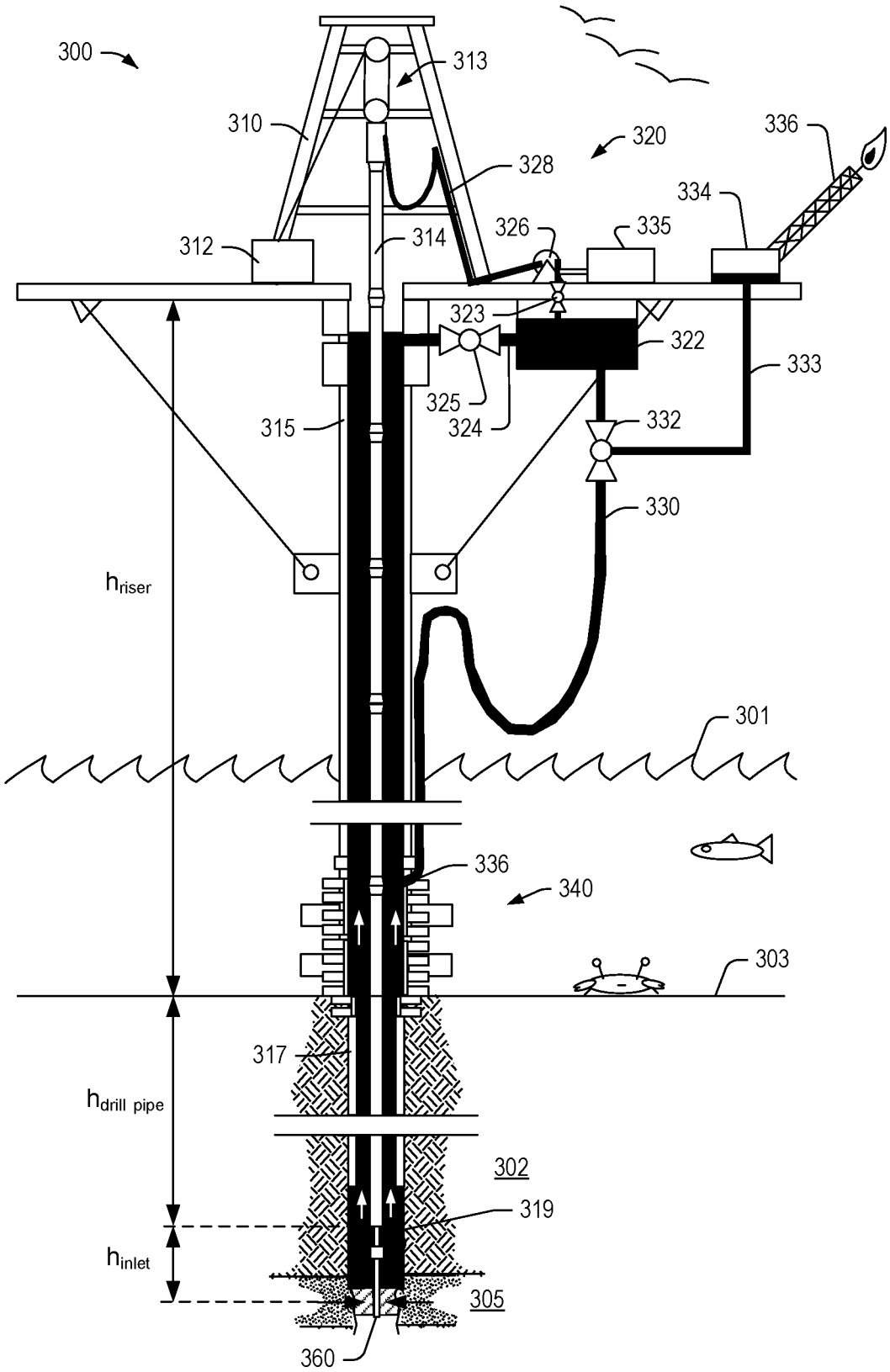
FIG. 3 is a schematic diagram of an example of a system.

FIG. 3 shows an example of a system 300 that includes surface equipment, underwater equipment and subsurface equipment where an air-water interface 301, a subsurface environment 302 and a seabed 303 are shown. The system 300 can include a rig 310 with a drawworks 312, a head assembly 313 (e.g., pulleys, traveling block, top drive, etc.), and a drillstring 314. As shown, a riser 315 can extend from the rig 310 to a blowout preventer (BOP) 340 where casing 317 can extend into the subsurface environment 302. As shown, the drillstring 314 can be disposed in part within the riser 315 and in part within the casing 317 where the drillstring 314 may extend beyond an end of the casing 317 into an openhole section 319 of a borehole (e.g., an uncased section of a borehole). In the example of FIG. 3, the subsurface environment 302 can include fluid 305 where a tool 360 may be deployed via the drillstring 314 for intake of the fluid 305 (see, e.g., arrows pointing toward the tool 360). FIG. 3 shows various heights which include a riser height ($h_{riser}$), a drillstring height as disposed in the subsurface environment 302 ($h_{drillstring}$) and an inlet height ($h_{inlet}$) as measured from the end of the drillstring 314 to an inlet of the tool 360.

In the example of FIG. 3, various equipment can provide for control of fluid, collection of fluid, etc. For example, the system 300 can include a fluid sub-system 320 that includes a tank 322, valves 323 and 325, a flow line 324, a pump 326 and a flow line 328 (e.g., a conduit, etc.). In the example of FIG. 3, the system 300 can include additional equipment such as, for example, a bypass line 330, a valve 332, a collection line 333, a collection tank 334, a substance tank 335 and one or more pieces of gas handling equipment 336 (e.g., gas separation, gas analysis, gas storage, gas flaring, etc.).

In the example of FIG. 3, various components of the equipment may operate for one or more purposes. For example, the tank 332 can be a lubricant fluid tank (e.g., mud, drilling fluid, etc.) that can supply the pump 326 to supply the flow line 328 where the flow line 328 supplies the drillstring 314 such that lubricant fluid can flow downwardly in a lumen of the drillstring 314, where flow of such fluid may be controlled using one or more downhole components. As explained, fluid may flow upwardly in an annular region about the drillstring 314 where, in the example of FIG. 3, the fluid can flow from the annular region to the flow line 324, which may be in fluid communication with the tank 322 and, for example, controlled via the valve 325. As shown, the valve 323 may control supply of fluid from the tank 322 to the pump 326. For example, the pump 326 may be supplied with a spacer fluid such that the pump 326 operates as a spacer fluid pump. A fluid sub-assembly may include various types of components such as, for example, separation components. For example, during various operations fluid may carry debris, cuttings, etc., which can be separated from the fluid where the fluid may be recirculated via the pump 326 to the drillstring 314.

As mentioned, the line 330 can be a bypass line 330, which may, in various instances, be operable as a kill line. A kill line can be a high-pressure pipe leading from an outlet on the BOP 340 to one or more rig pumps (e.g., the pump 326, etc.). During various operations, fluid may be pumped through the drillstring where annular fluid is taken out through a choke line (e.g., to a choke that may drop the fluid pressure to atmospheric pressure). If a drillpipe becomes inaccessible, it may be helpful to pump heavy drilling fluid into the top of the well, wait for the heavy fluid to fall under the force of gravity, and then remove fluid from the annulus. In such an operation, while one high pressure line may suffice, it can be more convenient to have multiple lines. As an example, a bypass line (e.g., or kill line) can provide a measure of redundancy for one or more operations. In floating offshore operations, a choke line and a kill line can be configured to exit the subsea BOP and run along the outside of the riser to the surface. The volumetric and frictional effects of a long choke line and/or a long kill line can be taken into account to properly control one or more operations.

In the example of FIG. 3, a single line is illustrate as a bypass line, noting that another line may be included such that the system 300 includes multiple lines that may operate as a choke line, a kill line, a bypass line, etc.

In the example of FIG. 3, the tank 335 may be a supply tank and the tank 334 may be a collection tank. For example, the tank 335 can supply fluid to the pump 326 and the tank 334 can collect fluid from the bypass line 330, which may be controlled via operation of the valve 332 and/or one or more other components.

In the example of FIG. 3, the heights $h_{riser}$, $h_{drillpipe}$ and $h_{inlet}$ may be utilized in one or more operational control scenarios. For example, a sum may provide an indication of fluid pressure (e.g., pressure head) in the openhole section 319 at the level of the inlet of the tool 360. In such an example, for the fluid 305 to flow into the openhole section 319, the pressure of the fluid 305 may have to be greater than the fluid pressure in the openhole section 319.

Pressure in a well may be controlled to reduce risk of undesirable flow of formation fluids. For example, a blowout may be defined as uncontrolled flow of formation fluids from a well. A blowout can be an uncontrolled flow of formation fluids from the wellbore or into lower pressured subsurface zones (e.g., underground blowout). In various instances, uncontrolled flows can demand specialized services intervention. In various instances, a blowout may produce fluid that can include one or more of water, oil and gas. Blowouts may occur during one or more types of well activities. In some circumstances, a well may bridge over, or seal itself with rock fragments from collapsing formations downhole.

In various instances, sampled fluid can be multiphase fluid, which may, for example, be routed to a separator. As an example, equipment may include injection equipment such as a chemical injection pump for injecting chemicals into multiphase fluid (e.g., flowing toward a separator, etc.), as may be desired.

As an example, a separator may be a three-phase separator that generally separates the multiphase fluid into gas, oil, and water components. In such an example, separated gas may be routed downstream from the separator (e.g., through a gas manifold, etc.) a burner for flaring gas. As an example, flaring equipment may provide for flaring gas and/or burning oil. In various instances, separated oil from a separator may be routed downstream to an oil manifold, an oil tank, etc. A tank for holding oil and/or other fluid can be of a suitable form (e.g., consider one or more vertical surge tanks each having one or more fluid compartments). As an example, a multi-compartment tank may simultaneously hold different fluids, such as water in one compartment and oil in the other compartment. As an example, an oil transfer pump may be operated to pump oil to one or more locations (e.g., for testing, disposal, storage, etc.). In various instances, separated water from a separator may be routed to a tank or other location.

Figure 7:
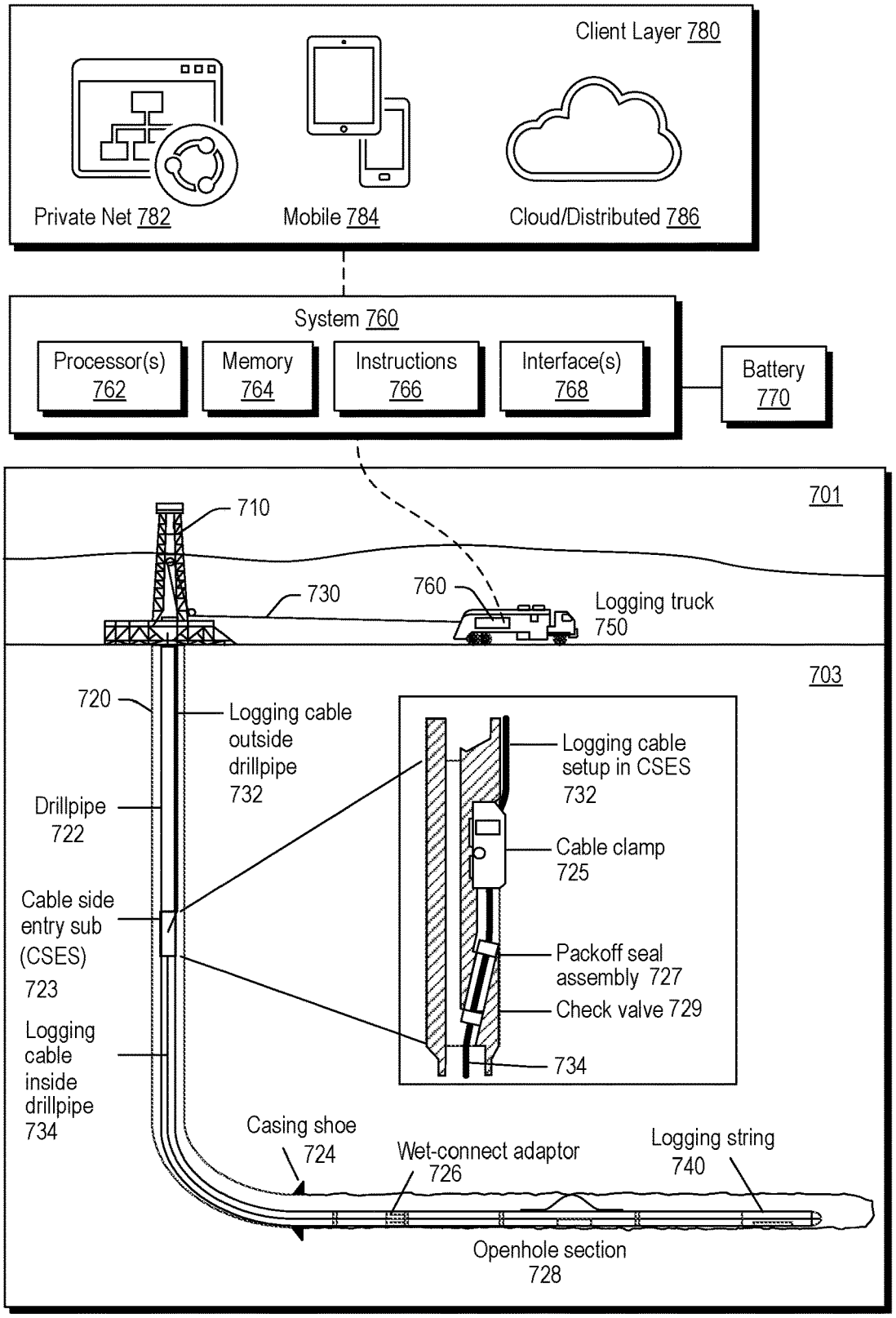
FIG. 7 illustrates an example of a system and examples of equipment in an example environment.

FIGS. 4A, 4B, 4C and 4D show various examples of operations with respect to a schematic diagram of various equipment that can include various components of the system 300 of FIG. 3; noting that various actions may be performed using equipment illustrated in one or more other drawings (see, e.g., FIG. 7, etc.).

In FIGS. 4A, 4B, 4C and 4D arrows are illustrated as to mud flow (e.g., lubricant fluid flow), spacer flow (e.g., spacer fluid flow) and formation flow (e.g., formation fluid flow).

Figure 4A:
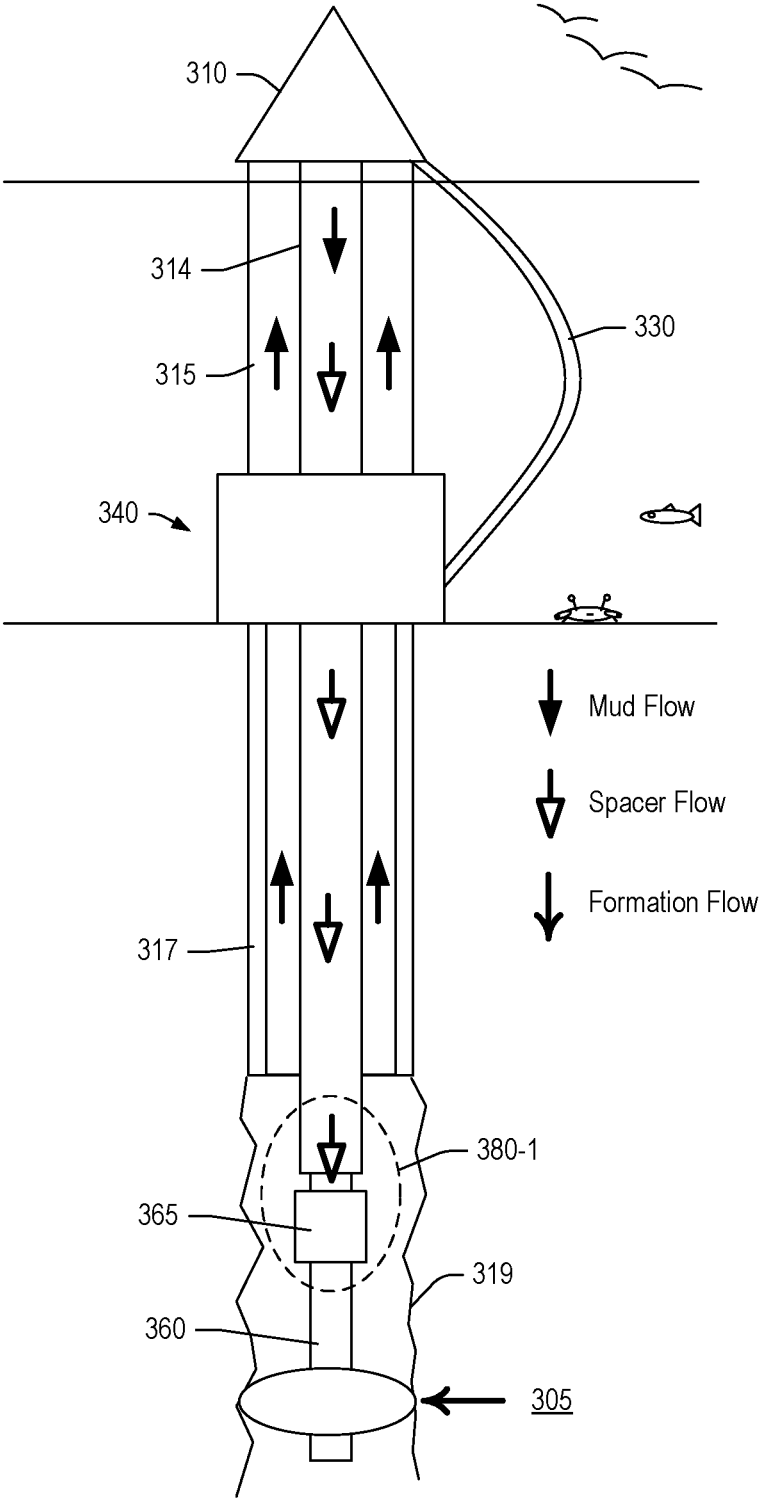
FIGS. 4A, 4B, 4C and 4D illustrate examples of systems and operations.

In FIG. 4A, a volume of spacer fluid flows via the drillstring 314 to a fluid controller 365 of the tool 360. In the example of FIG. 4A, the spacer fluid can flow to form a first spacer 380-1 that can enter an annular space (e.g., an annulus) as defined between an exterior surface of the drillstring 314 and an inner surface of the casing 317.

Figure 4B:
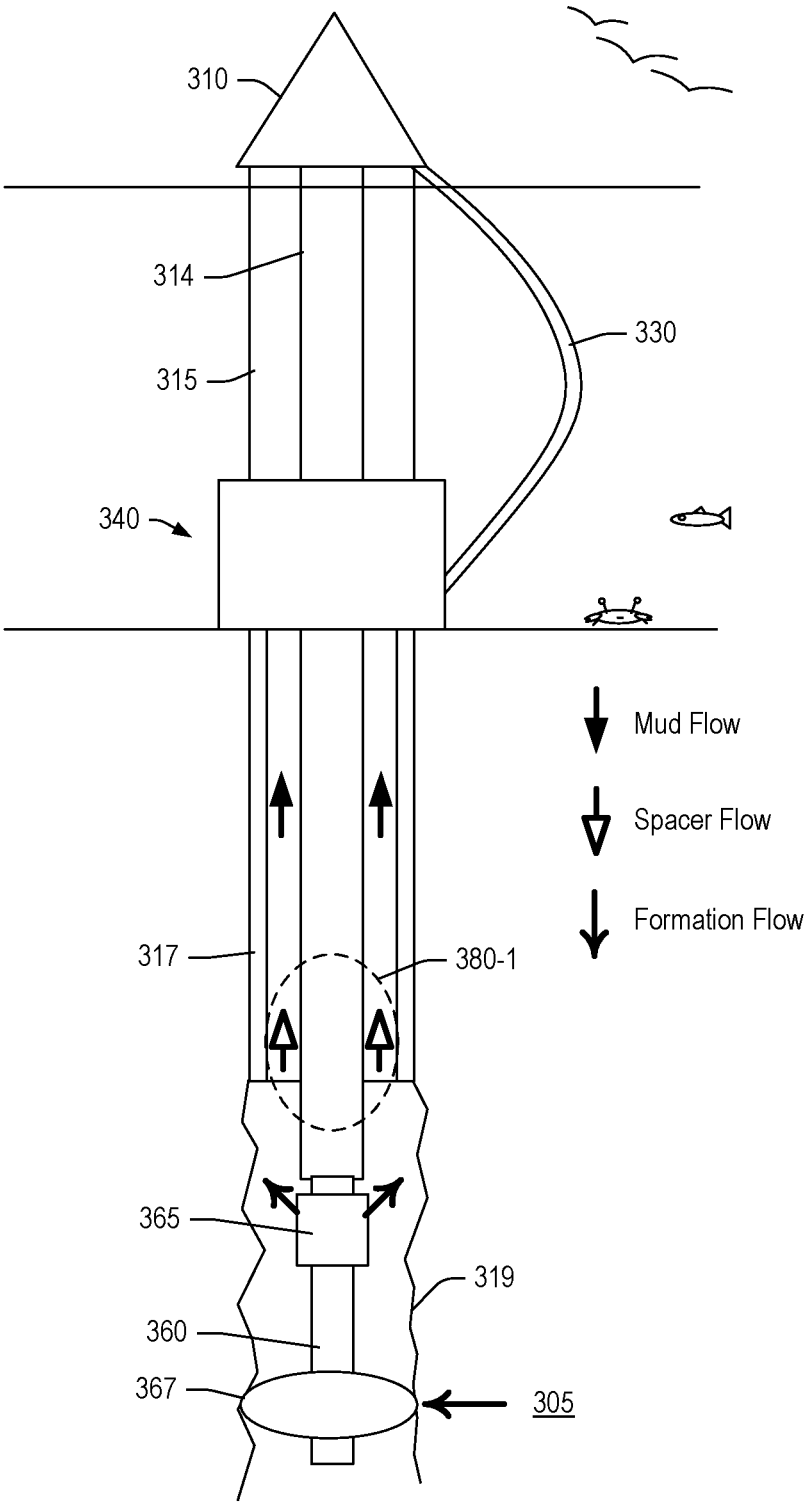

In FIG. 4B, the first spacer 380-1 flows in the annular space while formation fluid 305 flows into the tool 360, which may exit the tool 360 to also flow to the annular space below the first spacer 380-1. For example, the fluid controller 365 can regulate flow such that fluid can flow out of the tool 360 where the tool 360 can include at least one packer 367 that can be deployed for intake of the formation fluid 305. For example, consider a tool that includes at least one deployable packer and at least one inlet that can receive formation fluid form a formation such that the formation fluid can flow to a conduit of the tool. In such an example, the tool can include one or more components that can controllably allow the formation fluid to flow out of the tool and/or, one or more of, to flow to one or more sensors, to be captured in one or more sample chambers, etc.

Figure 4C:
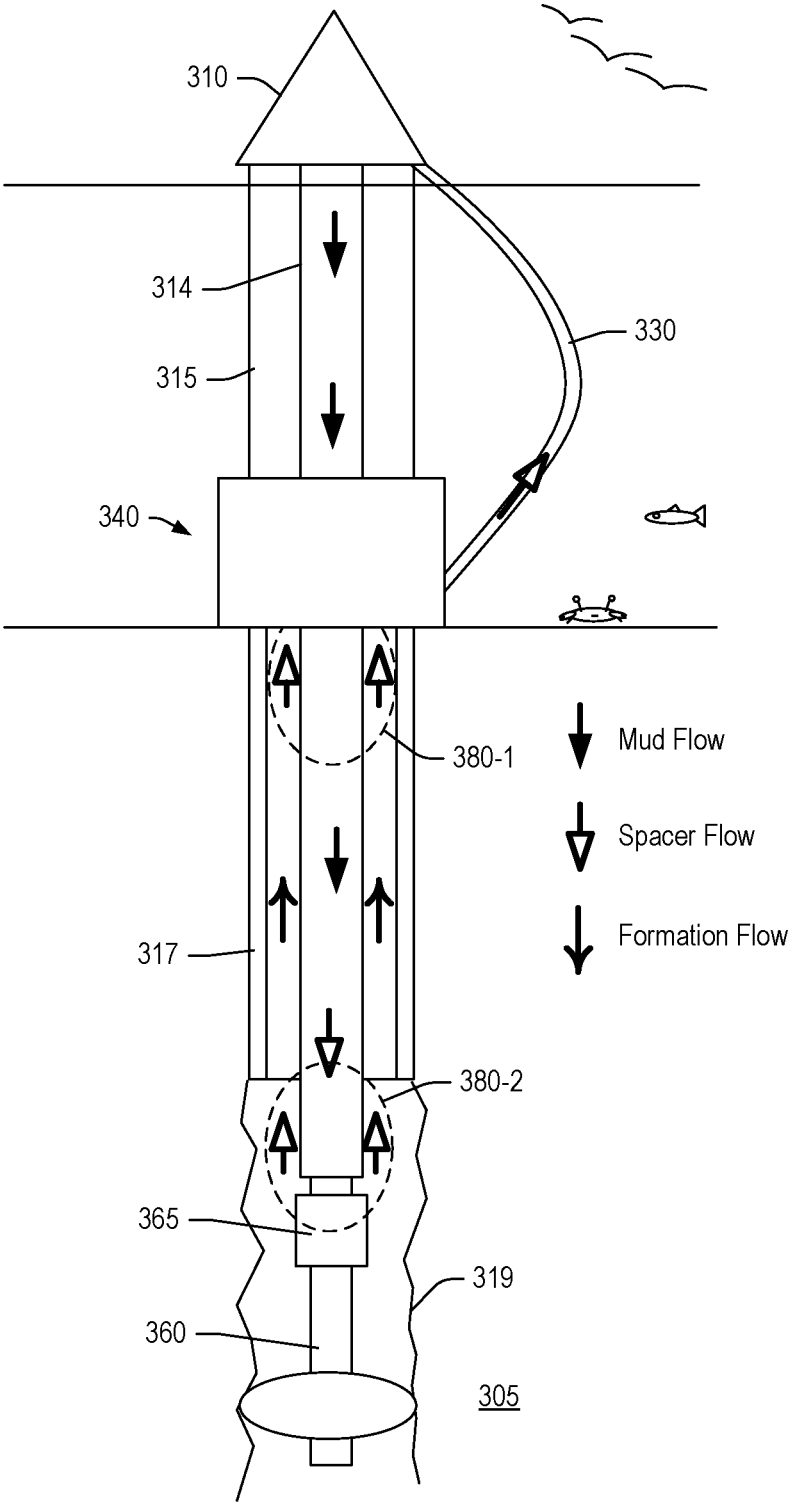

In FIG. 4C, the first spacer 380-1 flows to the bypass line 330 while spacer flow generates a second spacer 380-2 where, for example, the formation flow can be disposed between the first spacer 380-1 and the second spacer 380-2. In the example of FIG. 4C, the formation flow of the formation fluid is illustrated as being in the annular region and flowing upwardly toward the blowout protector 340, which, as explained, can be controllably in fluid communication with the bypass line 330. Further, in the example of FIG. 4C, mud flow may recommence, for example, to displace the spacer flow such that the second spacer 380-2 can flow upwardly behind the formation flow.

As explained, in the example of FIG. 4C, formation fluid is substantially isolated between the first spacer 380-1 and the second spacer 380-2; noting that a single spacer may be utilized where, for example, formation flow is injected to divide the single spacer into multiple spacers (e.g., two, three, etc.). Where a single volume of spacer flow is utilized, the flow controller 365 may regulate downhole flows such that the single volume can be divided to generate multiple spacers. As an example, a single volume of spacer fluid may be utilized where formation fluid is disposed substantially a single spacer and other fluid, which may be, for example, mud, etc.

Figure 4D:
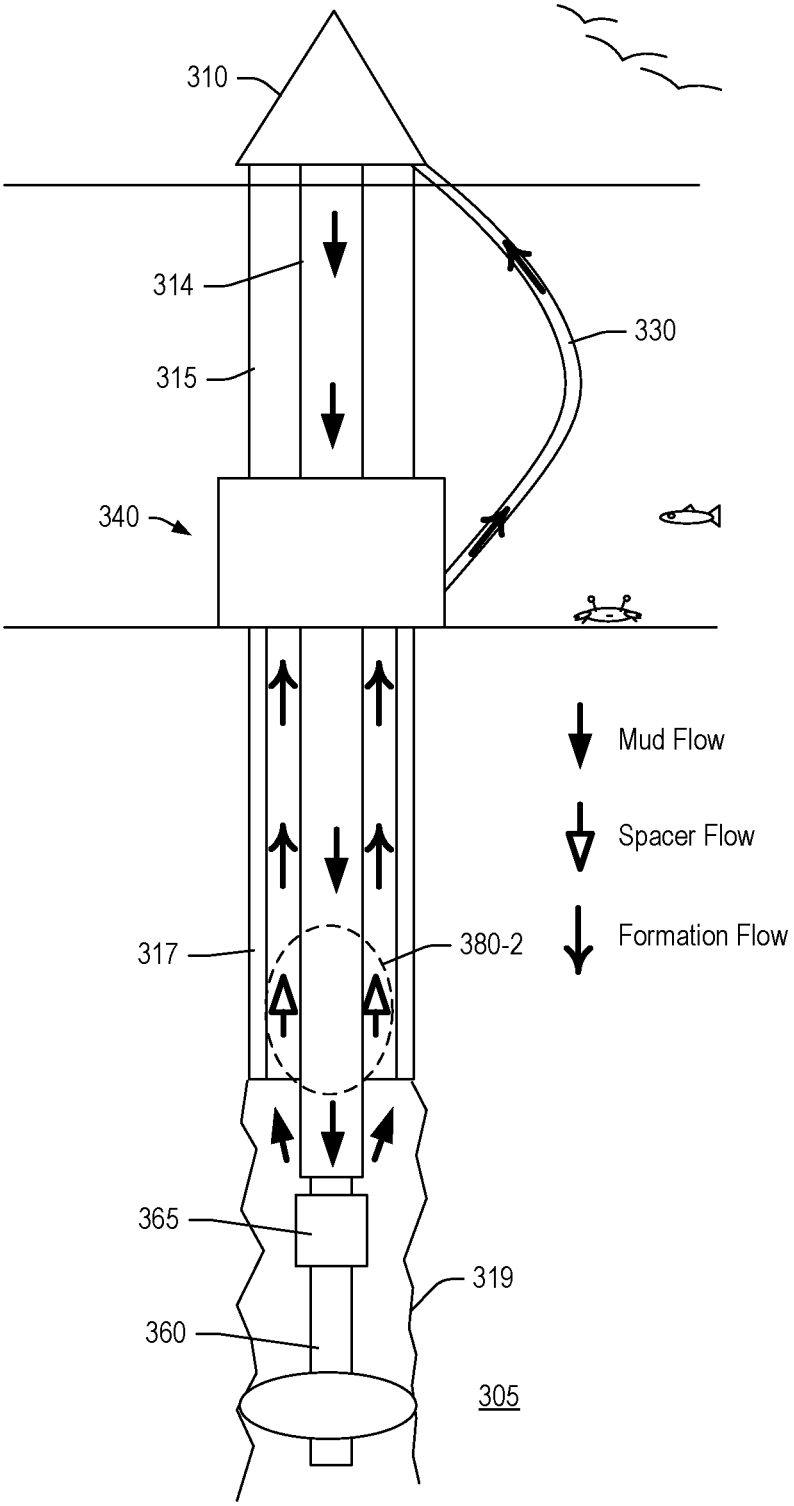

FIG. 4D shows the formation flow in the bypass line while the second spacer 380-2 travels upwardly in the annular region behind the formation flow. As shown, mud flow can recommence such that mud can enter the annular region behind the second spacer 380-2. In such an example, the mud flow can help drive the formation flow to surface via the bypass line 330. As an example, once the formation flow is complete, equipment of the BOP 340 may direct the second spacer 380-2 via the bypass line 330 and/or via the annular region between the riser 315 and the drillstring 314. As an example, the second spacer 380-2 may be of a volume sufficient to assure that the formation fluid exits the bypass line 330, which as explained, may be collected via the collection tank 334.

As explained, a BOP can be installed at the seabed for an offshore platform, and inhibit flow of fluids from the annulus into surrounding water. To permit the controlled flow of formation fluid and wellbore fluid to a rig for collection, analysis, and further circulation, a bypass line can be in fluid communication between the annulus and the rig. As shown in various examples, a BOP can include one or more fittings for a bypass line, etc.

As explained, a system can include a rig stationed at the surface, which may be an offshore platform, a land-based platform and derrick assembly, etc. As explained, a system can include surface rig equipment, along with the tanks for holding wellbore fluid and formation fluid.

A rig may be utilized to suspend a downhole tool such as the tool 360. As explained, the tool 360 can include a flow controller 365 that may be referred to as a circulation assembly, which may be positioned at or near its upper end, where the circulation assembly 365 can be in fluid communication with the tool 360 and the drillstring 314. The circulation assembly or flow controller 365 can permit flow of wellbore fluid, formation fluid, spacer fluid, and/or a mixture of one or more fluids.

Wellbore fluid or mud (e.g., oil-base mud (OBM) or water-base mud (WBM)) can be stored in a pit or tank at surface. As explained, a pump can deliver wellbore fluid to the interior of a drillstring (e.g., drillpipe), inducing the wellbore fluid to flow downwardly through the drillstring. The wellbore fluid can exits the drillstring via ports in a drill bit and/or one or more other features, and then circulate upwardly through the region between the outside of the drillstring and the wall of the wellbore (e.g., annulus or annular region). The wellbore fluid can lubricate a drill bit and carry formation cuttings up to the surface as it is returned to the pit or tank for recirculation.

As to OBM, it may be an invert-emulsion mud, or an emulsion whose continuous phase is oil. Various types of commercial oil muds may be formulated with 5 vol. % water or more or less than 5 vol. % water. Various types of nonwater-base drilling fluids can include synthetic fluid (e.g., ethers, esters, olefin oligomers, blends, etc.), diesel oil, and/or mineral oil (e.g., ordinary and enhanced purity). As to water-base muds, they can be defined as drilling fluid (mud) in which water or saltwater is the major liquid phase as well as the wetting (external) phase. General categories of water-base muds include fresh water, seawater, salt water, lime, potassium and silicate. As an example, a water-base mud can be a clear water, clay base, silicate, clay and polymer, polymer with low or no clay, clear brine, etc.

Various types of muds (e.g., drilling fluids, lubricants, etc.) may take time and resources to formulate. For example, consider a recipe for making mud that commences with one or more base materials, one or more ingredients, one or more premixes, etc., where the order of ingredients, mixing times, temperatures, etc., may be controlled. A formulated mud may be of considerable value and suitable for reuse. For example, after an operation is performed, at least a portion of the mud may be collected (e.g., in a tank, etc.) and transported to another site for use. As mentioned, where mud becomes contaminated beyond an acceptable level, processing and/or disposal may be options, which can add cost, time, resources, etc. In various examples, formation fluid may be sampled from a downhole environment in a manner that may help to preserve mud such that it does not become contaminated to a level that would demand substantial processing to clean the mud or that would result in disposal, which may be of an increased cost where hydrocarbon content is elevated. Further, as to disposal, various regulations can exist that control how and/or where mud is disposed. In general, mud with less contamination is easier and less expensive to handle than mud with more contamination.

As an example, a method for sampling formation fluid that includes hydrocarbons can reduce contamination of drilling fluid. In such an example, drilling fluid may be amenable for reuse and/or recycling where, for example, if drilling is involved, cuttings can be removed to recover the base fluid for reuse. In such an example, the base fluid can be stored, mixed with other mud, etc. In instances where mud is utilized as a lubricant without drilling, it may still carry solids, which may be removed such that a base fluid can be reused. In either instance (e.g., drilling or non-drilling) where formation fluid sampling is involved, a method that reduces contact between formation fluid and mud can help to preserve the mud (e.g., reduce risk of contamination).

In various instances, muds are leased from a drilling fluid company such that they can be recycled and reused. Some companies demand that certain drilling fluid properties are to be met before the mud is returned to a plant, otherwise a conditioning process and associated charge may apply. As to properties, these can include one or more of weight, viscosity, water ratio and low gravity solids content, various properties of which may be impacted by formation fluid hydrocarbons; noting that hydrocarbon composition and/or content may be regulated as well.

Whether OBM, WBM, etc., in serial operations that aim to reuse mud from well to well, such a process can be highly dependent on the condition of the mud at the end of a previous well. As explained, when sampling of formation fluid is involved, a method can utilize a spacer fluid or spacer fluids that can physically separate formation fluid from mud where a spacer fluid or spacer fluids may be formulated in a manner that helps to reduce mixing and/or to enhance separation. For example, consider a spacer fluid that is immiscible with hydrocarbons where spacer fluid and formation fluid may separate with or without application of one or more separation technologies. As an example, a spacer fluid may be immiscible with a particular mud such that mixing is reduced and/or such that separation is enhanced. As an example, hydrophobic and/or hydrophilic and/or lipophilic properties may be adjusted for a spacer fluid based at least in part on hydrophobic and/or hydrophilic and/or lipophilic properties of a mud and/or a formation fluid.

A miscible condition can pertain to a condition in which two or more fluids can mix in various proportions and form a single homogeneous phase. An immiscible condition can pertain to a condition in which two fluids are incapable of forming molecularly distributed mixtures or attaining homogeneity at that scale. For example, immiscible fluids can separate into two phases with an interface between them (e.g., consider oil and water as being immiscible).

Hydrophilic can pertain to an attraction for water by the surface of a material or a molecule. Clays and most other natural minerals used in drilling fluids, such as barite and hematite, are hydrophilic. They tend to spontaneously wet by water. To render them oleophilic, they can be treated with an oil-wetting chemical. As to hydrophobic, it can pertain to a repulsion of water by the surface of a material or a molecule. As to lipophilic, it can pertain to an attraction for oil by a surface of a material or a molecule. This term may be applied to the oil-wetting behavior of treatment chemicals for oil muds. Lipophilic oil-mud additives tend to be utilized as various minerals drilled and additives such as barite are naturally hydrophilic and benefit from being rendered lipophilic.

The method illustrated with respect to FIGS. 4A, 4B, 4C and 4D can be a method of isolating wellbore fluid from formation fluid. As explained, one or more spacers can be formed via flowing spacer fluid from a rig through drillpipe of a drillstring. A spacer can be a volume of spacer fluid that can exit a circulation assembly into an annulus. A spacer may be set such that it covers at least a portion of a circulation assembly. To optimize the isolation of the formation fluid from the wellbore fluid, a spacer can fully cover a circulation assembly. Thereafter, a quantity of formation fluid can be produced from the formation into a downhole tool, and exit the circulation assembly. In some embodiments, formation fluid may be injected inside a spacer (e.g., to divide a spacer, etc.). In various alternate embodiments, one or more additional spacers may be flowed out of a circulation assembly, for example, once a quantity of formation fluid has been released into the annulus.

As formation fluid is released into the annulus, it will begin to displace a spacer such that the fluids migrate upwardly in the annulus, for example, to enter a bypass line. Multiple spacers may be flowed through a circulation assembly into the annulus, depending upon desired sampling, etc. Once the desired quantity of formation fluid has been released, the wellbore fluid may be pumped through drillpipe of the drillstring. The positive pressure will further displace the one or more spacers and the formation fluid.

Figure 5A:
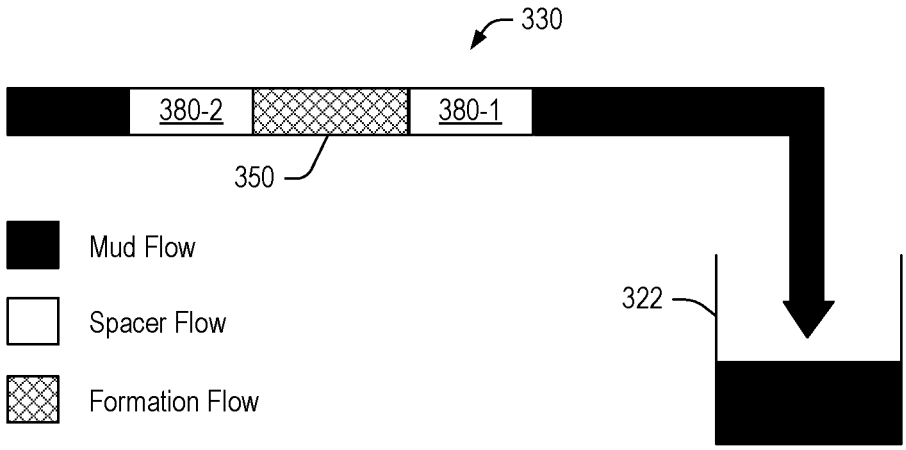
FIGS. 5A and 5B illustrate examples of methods and equipment.
Figure 5B:
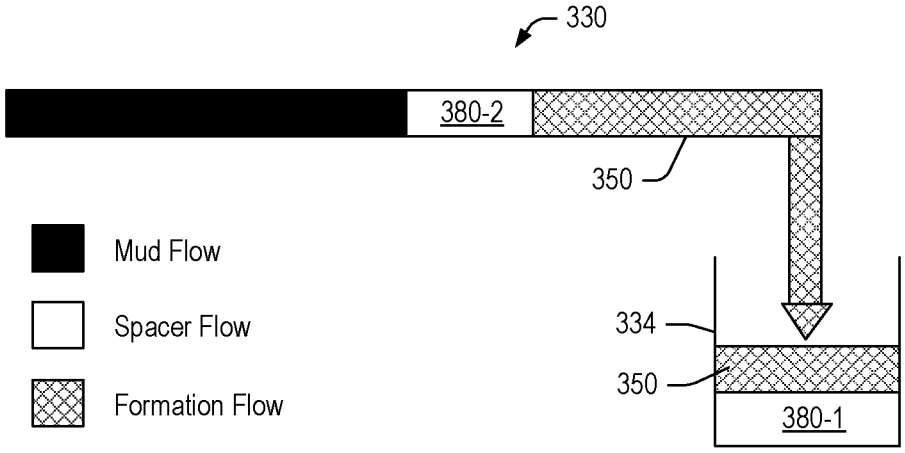

FIGS. 5A and 5B show schematic diagrams of flow in the bypass line 330 with respect to two tanks, the mud tank 322 and the collection tank 334. In the examples of FIGS. 5A and 5B, the mud flow, spacer flow and formation flow are illustrated using different fills where the mud flow is black, the spacer flow is white and the formation flow is cross-hatched. Further, the spacers 380-1 and 380-2 are illustrated along with a formation fluid 350 volume, which may be referred to as a formation fluid sample.

As explained, the bypass line 330 can carries the fluids to surface (e.g., to a rig system, etc.). Wellbore fluid may be collected in the mud tank 322 until the first spacer 380-1 is detected. Once the first spacer 380-1 has been detected (e.g., visually, via one or more sensors, etc.), the fluid flow can be directed to the other tank 334 to collect the first spacer 380-1 and at least a portion of the volume of the formation fluid 350. As an operator may know the approximate amount of spacer and formation fluid that was released into the annulus, and can monitor this quantity in the collection tank 334, or until the final spacer has been detected. Thereafter, the fluid flow can be redirected to the mud tank 322 to collect the return of the wellbore fluid.

To optimize the separation between the formation fluid and wellbore fluid, the spacer fluid can include a fluid that is immiscible in both the formation fluid and wellbore fluid. Such an approach can help to prevent mixing and contamination of the fluids.

As an example, wellbore fluid (e.g., mud) may be utilized in one or more operations, at one or more sites, etc. As an example, a wellbore fluid may be specified to include less than a certain amount of contaminants, which can include one or more hydrocarbons that can be in formation fluid. For example, if mud includes too high of a concentration of hydrocarbons, it may be unsuitable for re-used, transport, resale, etc.

As an example, one or more operations may be performed for a volume of formation fluid. For example, where formation fluid includes gas, one or more gas handling operations may be performed. For example, consider performing a flaring operation for evolved gas at surface and/or performing a gas containment operation. As an example, equipment can include one or more types of sensors that can provide measurements as to one or more types of fluids. For example, consider an analyzer for a volume of formation fluid, which may provide for detection of filtrate, spacer fluid, etc. As to filtrate, mud can include components that may infiltrate a formation at a borewall of an openhole portion of a borehole. Such infiltrate can be referred to as filtrate. Upon production of formation fluid from an openhole portion or a cased portion that has perforations, filtrate may be initially produced where such filtrate is to be separated from the formation fluid or otherwise handled as a mixture of filtrate and formation fluid.

In various instances, over-pressured mud within a wellbore may cause mud filtrate to infiltrate a formation and deposit a mud-cake on a wellbore surface. Mud-cake permeability tends substantially lower than formation permeability, which can thereby suppress pressure communication between a wellbore and formation fluid. However, circulation of mud and pumped-out formation fluid may hinder mud-cake growth. As explained, a sampling operation can include acquiring one or more samples that may be analyzed as to one or more determinations as to filtrate (e.g., infiltrate, invasion, etc.).

As an example, where two packers are utilized, a region between the two packers may include an amount of mud. In such an example, an inlet or inlets of a tool may receive the mud, followed by filtrate, followed by formation fluid, etc. In such an example, one or more samples may be analyzed with respect to such stages or phases of fluid flow.

As an example, a spacer fluid may be formulated to be miscible and/or immiscible with respect to one or more components. For example, consider a spacer fluid that is designed to reduce miscibility with mud and/or formation fluid. In such an example, the spacer fluid may be recovered to be reusable without processing and/or formation fluid may be recovered with having to process to remove spacer fluid. As an example, utilization of a relatively immiscible spacer fluid may help to distinguish one or more of the aforementioned stages or phases of fluid flow.

As an example, an analysis may facilitate performance of one or more clean-up operations. A cleanup can be a period when drilling debris and fluids are still coming out of the formation and perforations. During this time, the skin effect can be changing and one or more well-test results may reflect temporary obstruction to flow that may not be present in later tests.

As an example, an operation can be controlled to reduce risk of kick. A kick can be a flow of formation fluids into a wellbore during an operation. A kick can be physically caused by pressure in the wellbore being less than that of the formation fluid in a formation, thus causing flow. This condition of lower wellbore pressure than the formation may be a result of mud weight being too low, where the hydrostatic pressure exerted on the formation by the fluid column may be insufficient to hold the formation fluid in the formation or may be a result of a formation having a higher pressure than expected (e.g., an underbalanced kick). As an example, a kick can occur if dynamic and transient fluid pressure effects (e.g., due to motion of a drillstring or casing, etc.) that can effectively lower the pressure in the wellbore below that of the formation (e.g., an induced kick).

In various instances, conditions can change substantially from those of a downhole environment compared to those at surface. For example, pressure can be high and temperature can be high downhole where, while surface temperature may help to reduce expansion, the difference between downhole pressure and surface pressure can cause substantial expansion. In such instances, a measure of gas content and/or gas components can be helpful. For example, consider a tool that can include one or more sensors that can help determine a gas-oil ratio (GOR). In such an example, upon transport of a formation fluid volume uphole, gas may evolve and pose of risk of bypassing a spacer. For example, gas can be of a lesser density that the density of the spacer fluid such that buoyancy forces drive the gas through the spacer or between a surface of a drillpipe and the spacer fluid and/or a surface of casing and the spacer fluid. As an example, a method can include determining an amount of gas and/or gas components (e.g., via a GOR, etc.) and controlling a volume of a formation fluid sample and/or a volume of one or more spacers and/or one or more flow rates and/or one or more spacer fluid characteristics. For example, a smaller formation fluid sample is likely to evolve less gas and a larger spacer is likely to present a bigger obstacle to passage of gas through the spacer. As mentioned, where a substantial amount of gas or gas components are present in formation fluid, the volume of the formation fluid sampled can be controlled such that a risk of kicking is reduced. For example, in a column of fluids that aims to provide a hydrostatic pressure that is greater than a formation fluid pressure, gas is likely to contribute little to the hydrostatic pressure (e.g., head pressure). If a risk of kicking exists, to compensate, the density of a spacer fluid and/or an amount of spacer may be increased.

As an example, an operation can consider conditions at a BOP. For example, where a riser exists above a BOP, the head pressure of the riser may be considered. As an example, an operation may be performed in a manner where flow in a riser annular region is controlled (e.g., permitted, halted, etc.). For example, in FIG. 4C, the bypass line 330 may be controlled using appropriate equipment as may be provided with a seabed assembly in a manner that accounts for the annular region of the riser 315 and the drillstring 314.

As an example, a tool can include one or more types of sensors that can provide for measurements of one or more characteristics of formation fluid and/or filtrate in a formation. As an example, a tool can include taking measurements of fluid coming from a formation to determine a time at which filtrate has been expelled and "clean" formation fluid is flowing. As an example, a tool can provide for isolating the "dirty" fluid (e.g., filtrate and/or mixture of filtrate and formation fluid). In such an example, isolating can include halting flow and calling for a spacer. In such an approach, after arrival of the spacer, flow may continue in an effort to collect clean (e.g., cleaner) formation fluid, which may be of a desired amount (e.g., mass, volume, etc.), after which a signal may call for another spacer to isolate the formation fluid. In such an approach, three spacers may be utilized to capture a dirty sample and a clean sample. In such an approach, measurements taken downhole and/or uphole may provide for an indication of formation characteristics, which can include amount of invasion, which may inform one or more other operations (e.g., a cleanup operation, etc.).

A system may include a variety of adjustable parameters such as, for example, spacer fluid density, mud density, space fluid volume, number of spacers, spacer flow rate, mud flow rate, formation fluid flow rate, formation fluid volume, etc. In various instances, parameter values may be selected and/or controlled to provide for one or more desirable types and/or amounts of samples, where an operation or operations may provide for management of conditions to reduce risk of kicking.

As mentioned, a tool may be deployed via a drillstring where the tool may be inserted into the drillstring via one or more types of cables. As fluid can flow in the drillstring, fluid properties, fluid flow, etc., may be controlled to reduce risk of pressure, stress, forces, etc., that may be imparted to a cable by the fluid. For example, a dense, viscous fluid may during flow apply drag forces on a cable, which may act to increase the effective weight of the cable beyond the cable's own weight. As an example, a static fluid may impart some buoyancy force that may help to effectively reduce the effective weight of the cable. Thus, some fluid properties and/or fluid flows may be beneficial while some may be detrimental to use of a cable. As an example, an operation may be controlled to reduce risk of losing a cable where, for example, forces may be too great to thereby cause detachment of the cable, which may cause the cable to exit a drillstring and/or lodge in the drillstring. As explained, an operation may be controlled for purposes of cable integrity, for example, such that insulated electrical conductors maintain their integrity for purposes of power and/or data transmission (e.g., where data may include instructions and sensor data).

As to mud weight, it is the mass per unit volume of a drilling fluid, synonymous with mud density. Weight may be reported in lbm/gal (also known as ppg), $kg/m^3$ or $g/cm^3$ (also called specific gravity or SG), lb/ft$^3$ or in hydrostatic gradient, lb/in$^2$/ft (psi/ft) or pptf (psi/1000 ft). Mud weight can help to control hydrostatic pressure in a wellbore, which, as mentioned, can help to reduce risk of unwanted flow of formation fluid into a well. The weight of the mud can also help to support casing and an openhole section (e.g., reduce risk of collapse of casing and/or an openhole section). However, excessive mud weight can cause lost circulation by propagating, and then filling, fractures in formation rock. Mud weight (density) test procedures using a mud balance are standardized and published by the API.

As an example, spacer fluid and/or formation fluid may be characterized in a manner similar to mud. For example, consider a spacer fluid weight, a formation fluid weight, etc.

As to a specialized mud that may be for killing a well, it can be defined with a kill mud weigh to have a density high enough to produce a hydrostatic pressure at a point of influx in a wellbore that is sufficient to shut off flow into the well. As an example, density may be increased by adding material that includes barite or hematite. As an example, where desired, a spacer may be weighted using one or more materials such as barite or hematite.

As to hydrostatic pressure, it may be determined for a given depth, or the pressure exerted per unit area by a column of freshwater from sea level to a given depth. Abnormally low pressure might occur in areas where fluids have been drained, such as a depleted hydrocarbon reservoir. Abnormally high pressure might occur in areas where burial of water-filled sediments by an impermeable sediment such as clay was so rapid that fluids could not escape and the pore pressure increased with deeper burial.

As to formation pressure, it can be the pressure of fluid within pores of a reservoir, which may be measured in one or more manners. As reservoir pressure can change as fluid is produced from a reservoir, formation pressure can be described as measured at a specific time, such as initial reservoir pressure (e.g., for a particular depth). As an example, formation pressure can be the pressure of the subsurface formation fluid expressed as the density of fluid in the wellbore that is sufficient to balance the pore pressure. As an example, a normal pressure gradient might demand 9 lbm/galUS (e.g., 1.08 kg/m$^3$), while an extremely high gradient may need 18 lbm/galUS (2.16 kg/m$^3$) or higher.

Figure 6A:
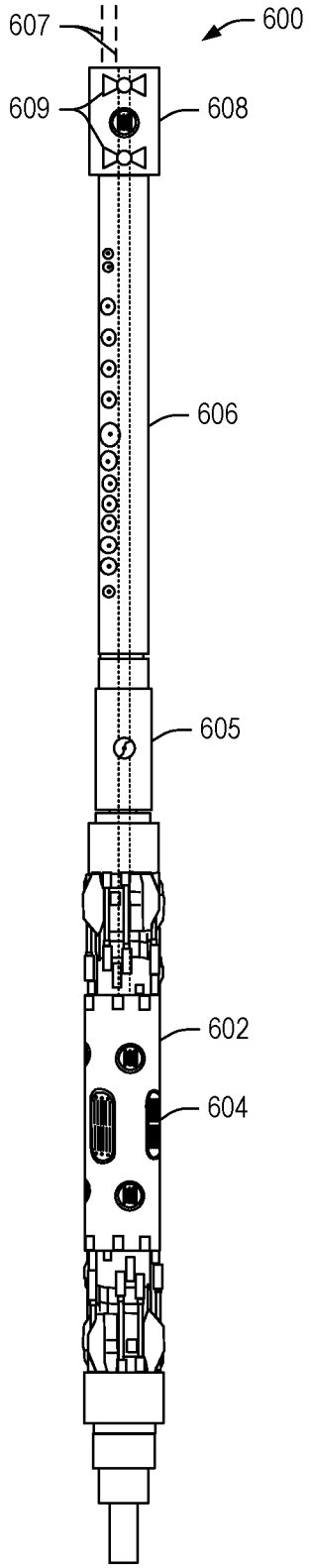
FIGS. 6A, 6B and 6C illustrate examples of tool features and methods.
Figure 6B:
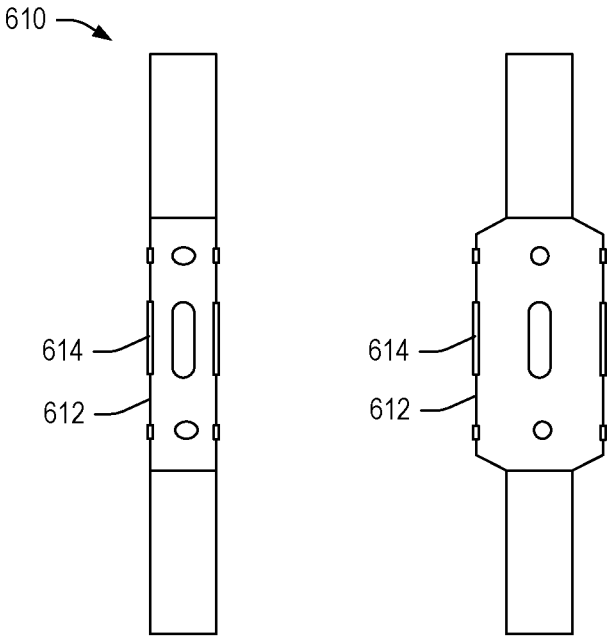
Figure 6C:
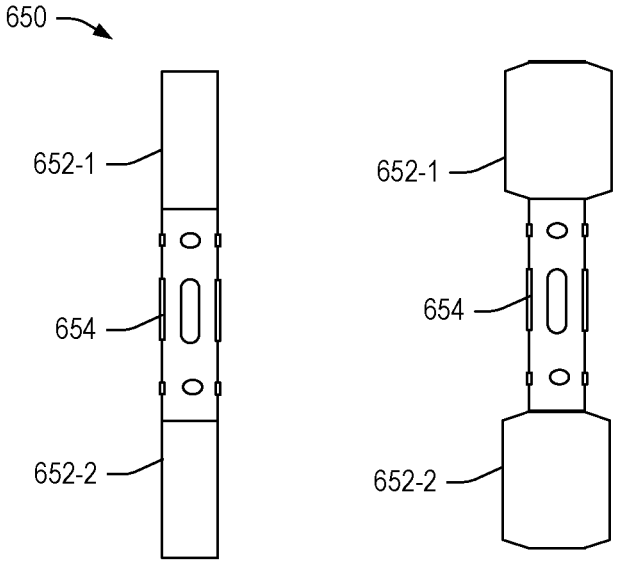

FIG. 6A, FIG. 6B and FIG. 6C show examples of tools 600, 610 and 650, which may be a portion of a larger tool. The tools 600, 610 and 650 can include one or more inlets 604, 614 and 654 and one or more expandable packers 602, 612, 652-1 and 652-2, such as an expandable packer assembly. As an example, the tools 600, 610 and 650 can provide for collection of one or more formation fluid samples via the one or more inlets 604, 614 and 654 where a sample may be conveyed to a desired collection location. As an example, a packer assembly can expand across an expansion zone where formation fluid may be collected (e.g., from an intermediate region of the expansion zone between axial ends of an outer sealing layer). In such an example, formation fluid collected may be directed along flowlines (e.g., along flow tubes, channels, etc.).

As an example, a tool can include a mechanism that can provide for expansion of a packer. For example, consider one or more pumps that can be actuated to generate pressure, move fluid, etc. As an example, a pump may operate to expand a packer and/or a pump may operate to move fluid as received via an inlet. As an example, a pump may be utilized to clear fluid from a tool, which may allow for a pressure differential to drive fluid into a tool. For example, where a formation fluid pressure exceeds an inlet pressure, then formation fluid can flow into the inlet.

As an example, a tool can include a packer with an outer layer (e.g., an outer skin) that is expandable in a wellbore to form a seal with surrounding a borewall across an expansion zone. As an example, a tool can include an inner, inflatable bladder disposed within an interior of an outer layer. In one example, the inner bladder (e.g., an inner packer) can be selectively expanded by fluid delivered via an inner mandrel.

As an example, a tool can include one or more features of the ORA platform (Schlumberger Limited, Houston, Tex.). The ORA platform includes various tool options, which include metrology options (e.g., various types of sensors that may be disposed in a sensor array, etc.). For example, consider a tool that includes a fluid in situ scanner that can measure one or more of density and viscosity, resistivity, and full-spectrum viscosity. As an example, a tool can include one or more pressure sensors (e.g., quartz, etc.) and/or one or more temperature sensors. As an example, a tool can include one or more sensors for measurement of oil, water and gas volume fraction, composition, color, etc. As to composition sensing, consider sensing of $C_1$ to $C_6$ or $C_{6+}$ (e.g., with uncertainty less than approximately 6 weight percent) and, for example, sensing of $CO_2$. As to fluid density, consider a range from approximately 0.01 to 2.0 g/cm$^3$. As to fluid viscosity, consider a range from 0.1 to 300 cP. As to color, consider optical density as a measurement. As to optical measurements, for example, a tool can include a spectrophotometer, a fluorescence meter, etc.

As an example, the tool 600 can include various features of the ORA platform. For example, the tool 600 is shown as including a sensor array 606. In the example of FIG. 6A, the tool 600 is shown as including a pumping assembly 605, power and/or data lines 607 and a fluid controller 608. Such a fluid controller can include passages and one or more valves 609. As an example, the fluid controller 608 can receive fluid in one or more manners. For example, consider receipt of fluid via an upper inlet, a lower inlet and/or a side inlet where an inlet may be in fluid communication with a passage, where flow may be controlled. As an example, the fluid controller 608 can include one or more outlet where, for example, an inlet may be operable as an outlet or vice versa. As explained, fluid may be directed from a lower portion of the tool 600 upwardly to an upper portion of the tool 600 where the fluid may flow via one or more outlets to an annular space that may be defined at least in part by an outer surface of a portion of the tool 600.

In the example of FIG. 6A, the tool 600 may include one or more passages that extend at least in part axially along the tool 600. As an example, fluid may be directed, for example, in a controllable manner, to one or more sensors of the sensor array 606, which may include a port or ports. For example, consider flowing fluid from the inlet 604 to a passage and to a sensor of the sensor array 606 for performing one or more measurement where the fluid may pass out of the tool 600 via a port. As an example, the pump assembly 605 may include one or more pumps that can be in fluid communication with one or more passages, which may be via control of one or more valves, etc. As an example, a pump may be utilized for one or more purposes, which can include, for example, one or more of sampling, moving fluid along the tool, moving fluid out of the tool, moving fluid to a sensor, moving fluid to sensors, moving fluid into the tool, inflating one or more packers, etc. As an example, one or more packer assemblies may be positioned along a length of the tool 600 and/or operatively coupled to the tool 600 and/or inflatable to form a seal against a surface of the tool 600.

As explained, a tool can include one or more packer assemblies where, for example, an inflatable seal or seals may be transitioned from an uninflated state to an inflated state. For example, consider introduction of fluid at hydrostatic pressure into the interior of an inflatable seal that can cause the inflatable seal to inflate until one or more layers of the inflatable seal have contacted a formation or a wellbore wall (e.g., casing or open wellbore wall). In such an example, the inflatable seal can inflate due to the hydrostatic pressure within the interior of the inflatable seal being greater than a pressure in a drawdown zone (e.g., a sampling zone for inflow of formation fluid, etc.). A process referred to as drawdown may include use of one or more pumps (e.g., rotating, reciprocating, piston, etc.) in the tool 600, which may be utilized to decrease the pressure in a drawdown zone to cause fluid from the formation to enter one or more inlets (e.g., on a packer assembly, between packers, etc.). When the pressure in a drawdown zone is less than a formation pressure, the differential pressure may cause fluid to flow out from the formation and into the drawdown zone. An inflatable seal or seals can help to hinder fluid in a sampling zone from mixing with other fluid.

As an example, the tool 600 can include various types of circuitry, including digital circuitry, which may provide for control of one or more features. The tool 600 can include a multi-flowline architecture and downhole automation capabilities. As an example, the tool 600 can include one or more wideband downhole pumps that may be automated via flow control, for example, with flow rates that may be, for example, in a range from approximately 0.001 bbl/d to over 100 bbl/d. As an example, the sensor array 606 may be operable from an inside out approach and/or an outside in approach, for example, depending on direction of fluid flow. As an example, a multi-flowline fluid analyzer can be included in the sensor array 606 that can help to quantify fluid properties with laboratory-accuracy metrology (e.g., consider one or more of multi-flowline spectrometry, calibrated resistivity, high-accuracy density, wide-spectrum viscosity, high-accuracy and -resolution pressure gauges, etc.).

As to some examples of formation fluid samples, consider a well that may produce 100 bbl/day or more where a sample may be in a range from less than a barrel to more than 20 barrels (e.g., consider 25 bbl of formation fluid). As an example, a sample may be of a volume from a few liters to a thousand liters or more. As explained, sampling may be controlled optionally using one or more types of sensor data. For example, the flow controller 608 may be controlled locally downhole and/or from surface (e.g., a surface station, etc.) using one or more types of sensor data. As an example, consider a method where sensor data values acquired using the sensor array 606 can automatically control (e.g., trigger) one or more valves of the flow controller 608. In such an example, where formation fluid sampled via the inlet 604 (e.g., where the packer 602 is inflated, etc.) reaches a relatively "clean" (e.g., relatively constant readings) state, the flow controller 608 may direct flow to an annular region (e.g., via an outlet of the tool 600, an outlet of the flow controller 608, etc.). As an example, the flow controller 608 may be part of the tool 600 or may be operatively coupled to the tool 600 to perform one or more tasks as to sampled fluid, etc.

As to sizes of a riser, casing, a drillstring, etc., diameters may be generally less than approximately 1 meter. For example, consider a tool that is capable of being deployed in a borehole in a diameter with a range from approximately 20 cm to approximately 35 cm. In such an example, the tool can have a diameter of about 12 cm and include one or more packers that can be extendable to a diameter sufficient to contact a borewall of a borehole (e.g., for isolation of a formation region for sampling, etc.). As an example, a tool may have a length that is in excess of 1 meter, which may be as long as 30 meters or more. As to mass, consider a tool that has a mass of approximately 100 kg to approximately 1000 kg or more.

As mentioned, a tool can include one or more pumps. For example, the ORA platform provides a tool that can include multiple pumps. In such an example, a pump may be dedicated for sample and guard flowlines where pump control circuitry can provide for control of rate and pressure in each line. As an example, flow rates may be in a range from approximately 0.05 $cm^3/s$ to approximately 200 $cm^3/s$ or more (e.g., 0.025 to 108 bbl/day) and with differential pressure up to approximately 55 MPa or more (e.g., 8,000 psi or more).

As mentioned, equipment may be provided for handling of gas. For example, consider a separator that can separate one or more components of formation fluid as sampled using a downhole tool. As an example, handling of gas can include handling of pressurized samples and/or unpressurized samples of fluids, which may be collected in a sample chamber, a tank, etc.

FIG. 7 shows an example of an environment 701 that includes a subterranean portion 703 where a rig 710 is positioned at a surface location above a bore 720. In the example of FIG. 7, various wirelines services equipment can be operated to perform one or more wirelines services including, for example, acquisition of data from one or more positions within the bore 720.

In the example of FIG. 7, the bore 720 includes drillpipe 722, a casing shoe, a cable side entry sub (CSES) 723, a wet-connector adaptor 726 and an openhole section 728. As an example, the bore 720 can be a vertical bore or a deviated bore where one or more portions of the bore may be vertical and one or more portions of the bore may be deviated, including substantially horizontal.

In the example of FIG. 7, the CSES 723 includes a cable clamp 725, a packoff seal assembly 727 and a check valve 729. These components can provide for insertion of a logging cable 730 that includes a portion 732 that runs outside the drillpipe 722 to be inserted into the drillpipe 722 such that at least a portion 734 of the logging cable runs inside the drillpipe 722. In the example of FIG. 7, the logging cable 730 runs past the wet-connect adaptor 726 and into the openhole section 728 to a logging string 740. As an example, the logging string 740 can include a tool such as, for example, the tool 600 of FIG. 6. For example, the logging string 740 can provide for sampling where a sample may be set off by one or more spacers (e.g., spacer fluid(s)) and collected at a station at the rig 710 (e.g., a container, a tank, etc.).

As shown in the example of FIG. 7, a logging truck 750 (e.g., a wirelines services vehicle) can deploy the wireline 730 under control of a system 760. As shown in the example of FIG. 7, the system 760 can include one or more processors 762, memory 764 operatively coupled to at least one of the one or more processors 762, instructions 766 that can be, for example, stored in the memory 764, and one or more interfaces 768. As an example, the system 760 can include one or more processor-readable media that include processor-executable instructions executable by at least one of the one or more processors 762 to cause the system 760 to control one or more aspects of equipment of the logging string 740 and/or the logging truck 750. In such an example, the memory 764 can be or include the one or more processor-readable media where the processor-executable instructions can be or include instructions. As an example, a processor-readable medium can be a computer-readable storage medium that is not a signal and that is not a carrier wave.

As an example, the system 760 can perform a method that includes sampling where a sample or samples may be acquired using at least the logging string 740 where the sample or samples may be offset to one or both sides by a spacer (e.g., spacer fluid(s)). In such an example, the system 760 may acquire sensor data from the logging string 740 and instruct the logging string 740 to perform one or more actions. As an example, equipment at surface (e.g., at a surface station) may be controlled or otherwise instructed using the system 760. For example, where a volume of formation fluid is acquired and flowed to surface in an annulus and/or a bypass line, surface equipment may be operated to separate at least a portion of the volume of formation fluid from one or more other fluids (e.g., mud, lubricant, spacer fluid, etc.).

As mentioned, equipment at a station may include one or more features for handling gas. For example, consider a gas-fluid separator that can separate gas where separated such as hydrocarbon gas may be directed to a tank and/or flared. In the example of FIG. 7, one or more sensors may be located at a station such that formation fluid (e.g., oil, water, gas, etc.) can be analyzed. In such an example, the system 760 may acquire such data and process such data, optionally in combination with data acquired via one or more sensors of the logging string 740. As an example, where fluid is produced at a station at an elevated pressure, one or more techniques may be implemented for adjusting pressure (e.g., depressurizing to reduce pressure, etc.). In such an example, liberation of gas may be controlled where the gas can be handled appropriately, optionally with sensing of composition, etc., which may help control a flaring process, a storage process, etc. As an example, where artificial lift is implemented, gas may be circulated for injection downhole in one or more wells.

FIG. 7 also shows a battery 770 that may be operatively coupled to the system 760, for example, to power the system 760. As an example, the battery 770 may be a back-up battery that operates when another power supply is unavailable for powering the system 760 (e.g., via a generator of the wirelines truck 750, a separate generator (e.g., gas turbine engine, internal combustion piston engine, a power line, etc.). As an example, the battery 770 may be operatively coupled to a network, which may be a cloud network. As an example, the battery 770 can include smart battery circuitry and may be operatively coupled to one or more pieces of equipment via a SMBus or other type of bus.

As an example, the system 760 can be operatively coupled to a client layer 780. In the example of FIG. 7, the client layer 780 can include features that allow for access and interactions via one or more private networks 782, one or more mobile platforms and/or mobile networks 784 and via the "cloud" 786, which may be considered to include distributed equipment that forms a network such as a network of networks. As an example, the system 760 can include circuitry to establish a plurality of connections (e.g., sessions). As an example, connections may be via one or more types of networks. As an example, connections may be client-server types of connections where the system 760 operates as a server in a client-server architecture. For example, clients may log-in to the system 760 where multiple clients may be handled, optionally simultaneously.

The system 300 of FIG. 3 and the system of equipment disposed in the environment 701 of FIG. 7 may include common features, a mix of features, etc. As explained, in some instances, a cable may pass along drillpipe exterior to the drillpipe and/or may pass along drillpipe interior to the drillpipe; noting that directions of flow may be different interior and exterior, which may affect forces, wear, etc., of a cable. In the example of FIG. 7, a bypass line may be present at surface and/or at a depth below surface where the bypass line may be in fluid communication with the annular region between the drillpipe 722 and casing of the borehole 720. In various instances, a bypass line may be in fluid communication with a mud return line where the flow in the mud return line may be directed to the bypass line, which may lead to a station with a tank, a container, etc.

As an example, the system 760 can be a system controller that may be utilized for one or more systems (see, e.g., FIG. 1, FIG. 2, FIG. 3, FIGS. 4A, 4B, 4C and 4D, FIGS. 5A and 5B, FIG. 7, etc.). As an example, the system 760 can be a system controller that can instruct a spacer fluid pump to pump spacer fluid to a conduit, instruct a tool to flow formation fluid, where at least a portion of the spacer fluid and at least a portion of the formation fluid flow sequentially to an annulus, from the annulus to a bypass line and from the bypass line to a station, and instruct the station to collect a volume of the formation fluid.

As explained, a method can help to minimize rig mud system contamination when flowing a volume of formation fluid from a formation using a downhole tool such that the volume of formation fluid can be collected at a station uphole (e.g., at surface). As an example, formation fluid may flow from a formation into a passage of a downhole tool via one or more inlets, which may be isolated from a borehole via one or more packers.

As an example, a method can include conveying a tool downhole (e.g., using wireline, drillpipe, etc.) to a desire depth, introducing a volume of spacer fluid (e.g., non-miscible fluid with mud and/or formation fluid hydrocarbon(s)). In such an example, one or more spacers may be created using the spacer fluid to help isolate a sampled volume of formation fluid in a manner that reduces contamination of mud and/or that helps to reduce contamination of the sampled volume of the formation fluid from. In such an example, the spacer fluid and sampled formation fluid can be displaced into an annular region for movement uphole to a station (e.g., in a substantially plug flow manner). In various examples, a downhole tool can introduce sampled formation fluid into a region that is in fluid communication with an annular region and/or that is an annular region. Such an operation may be performed using the downhole tool, for example, using a downhole flow controller, one or more downhole pumps, etc., without utilizing a surface rig pump or surface rig pumps. In various examples, once formation fluid has been sampled via a downhole tool, a surface rig pump may be actuated to flow mud downhole, which can flow into the annular region behind the sampled formation fluid (e.g., directly and/or with a spacer therebetween), such that the mud flow can drive the one or more spacers and the sampled formation fluid uphole to a station (e.g., a surface station). As explained, such a process can place formation fluid inside a spacer (e.g., a pile, etc.) or between two spacers (e.g., two piles). At the station, emergence of spacer fluid can indicate the arrival of a lead spacer, which can indicate that the sampled formation fluid will follow. In such an example, where the volume of the lead spacer is known, along with a flow rate, a time may be determined for collection of the sampled formation fluid. As an example, where the volume of formation fluid is known, along with a flow rate, a time may be determined for an expected end to flow of the formation fluid and the commencement of spacer fluid and/or mud flow, etc. As an example, equipment can be provided that can divert spacer fluid and/or formation fluid to a tank, a separator, etc.

As an example, a workflow can include performing a series of operations at different depths (e.g., measured depths) to collect a series of samples of formation fluid. Such an approach may aim to determine an acceptable location for installation of equipment, hydraulic fracturing, forming perforations, etc.

As explained, a method can help to reduce contamination of OBM, which may be SOBM, with hydrocarbon(s) from a formation (e.g., a formation reservoir). In various instances, a mud supply company that supplies OBM may consider its mud non-reusable or non-resalable if the hydrocarbon content exceeds a certain level such as, for example, one percent of formation hydrocarbon(s) in the mud. As explained, various physical and/or chemical characteristics can favor or disfavor mixing of mud and formation hydrocarbon(s). Where OBM is utilized, hydrocarbon(s) from a formation can be miscible in the OBM such that in an instance or over time the OBM becomes contaminated at a level that confounds separation (e.g., practically, resource-wise, etc.).

As explained, spacer fluid can be formulated in a manner (e.g., physically, chemically, etc.) that helps to reduce contamination. For example, consider a spacer fluid with a hydrophilic character that tends to resist physical mixing and/or miscibility with OBM and/or formation hydrocarbon(s). Hydrophilic character may be one of various characteristics of spacer fluid in such an example. As to one or more other characteristics of spacer fluid, consider including one or more oil-absorbent materials (e.g., one or more oil-absorbent polymers such as methylmethacrylate (MMA), butyl acrylate (BA), hexadecyl methacrylate (HMA), etc., mixtures thereof, etc.) that can help to reduce risk of transmission of hydrocarbon(s) through a spacer (e.g., from mud to formation fluid and/or vice versa). As an example, an oil-absorbent material may be a particulate (e.g., granular) material that can be suspended or otherwise stabilized throughout a spacer fluid. As an example, an oil-absorbent material may act to migrate toward an interface between a spacer fluid and mud and/or between a spacer fluid and formation fluid. In various instances, one or more types of surfactants may be utilized. As an example, an oil-absorbent material may have surface characteristics, which may help to isolate hydrocarbon(s) that may contact spacer fluid (e.g., consider micelle generation, micelle enlargement, etc., that can help to isolate hydrocarbon(s)). As an example, a spacer fluid may include one or more absorbent materials that can be collected or otherwise separated out of the spacer fluid where, for example, the spacer fluid may be replenished with such one or more absorbent materials upon or after collection at surface.

As an example, a spacer fluid may be formulated with a dye (e.g., a dispersing dye, dyed particles, etc.). For example, consider utilizing a red dye, a green fluorescent dye, etc., which may help with machine vision and/or human vision at a station in timing, controlling, etc., collection of sampled formation fluid, spacer fluid, etc. For example, upon observation of the dye, a valve may be actuated to collect spacer fluid and/or formation fluid (e.g., where the formation fluid may be expected to follow the spacer fluid).

As explained, a method can help to isolate a formation's hydrocarbon(s) from mud and, for example, such a method may also include discharging and/or otherwise separating a relatively small portion of mud that may have been contaminated from a mud whole system (e.g., consider a portion of mud at an interface with spacer fluid, etc.). As explained, surface equipment can include conduits, valves, controllers, tanks, etc., which may be utilized for diverting and/or collecting contaminated mud.

As an example, where a series of samples of formation fluid is collected, a method may act to minimize a mud volume between samples (e.g., as may be separated using spacer fluid, etc.). In such an example, a minimal volume of mud may be diverted and/or collected as being at a higher risk of contamination.

As explained, a downhole tool may be operable to sample a desired volume of formation fluid where the volume can be larger than a volume of the downhole tool (e.g., consider a sample chamber of the downhole tool, etc.). As explained, a sample may be greater than 10 bbl in volume. As an example, where a downhole tool includes one or more sample chambers, one or more samples may be collected in the downhole tool, which may be subject to analysis locally by one or more sensors of the downhole tool and/or at surface once the downhole tool has been retrieved. As an example, where a downhole tool includes a sample chamber that can be filled and released downhole, a sample may be released into spacer fluid such that the sample can be driven upward to surface via mud flow. In such an example, the sample volume may be relatively small and captured at surface by capturing the spacer fluid where the sample volume may be separated from the space fluid.

Figure 8:
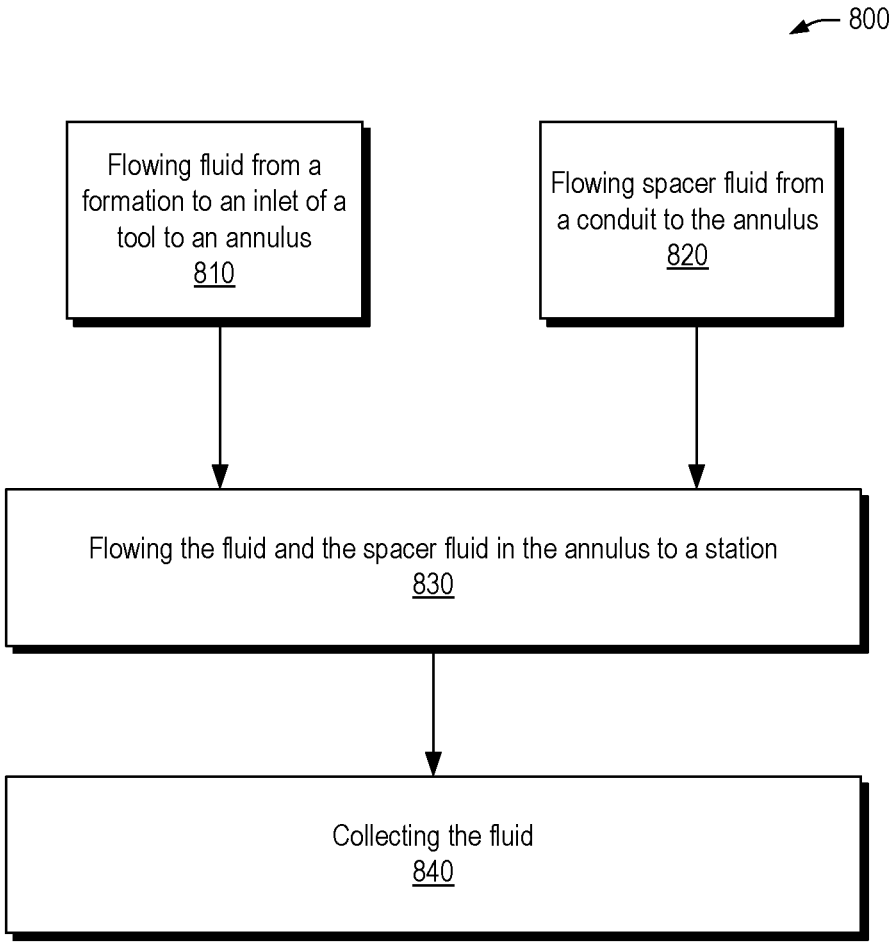
FIG. 8 illustrates an example of a method.

FIG. 8 shows an example of a method 800 that includes a flow block 810 for flowing fluid from a formation from an inlet of a tool to an annulus; a flow block 820 for flowing spacer fluid from a conduit to the annulus; a flow block 830 for flowing the fluid and the spacer fluid in the annulus to a station; and a collection block 840 for collecting the fluid. As explained, such a method may flow formation fluid and spacer fluid in one or more manners such that one or more spacers are formed adjacent a volume of formation fluid. In such an example, the volume of formation fluid may be collected in a manner where it may be relatively free of mud and, for example, where mud may be kept relatively separate from the volume of formation fluid. Such a method may be performed at an offshore site and/or at an onshore site.

As an example, a station may be a surface station that includes one or more pieces of equipment. For example, consider a pit, a tank, a container, etc., that can be utilized to receive at least a portion of formation fluid sampled in a downhole environment. As explained, a station may include one or more types of testing equipment that can include one or more sensors for analyzing sampled fluid.

As an example, a method can include flowing fluid from a formation from an inlet of a tool to an annulus; flowing spacer fluid from a conduit to the annulus; flowing the fluid and the spacer fluid in the annulus to a station; and collecting the fluid. In such an example, flowing the fluid and the spacer fluid in the annulus to the station can include utilizing a bypass line that bypasses a portion of the annulus that extends to a rig platform. In such an example, the bypass line may be in fluid communication with a blowout preventer.

As an example, a method can include formulating a spacer fluid. For example, consider formulating one or more characteristics of a spacer fluid for one or more purposes (e.g., density, miscibility, immiscibility, detectability, absorbency, etc.). As an example, a spacer fluid can be immiscible with formation fluid and/or immiscible with wellbore fluid (e.g., mud). As an example, a method can include selectively flowing formation fluid and a spacer (e.g., formed using spacer fluid) into a first surface containment, and selectively flowing wellbore fluid (e.g., mud) into a second surface containment.

As an example, spacer fluid can be formulated to reduce miscibility with hydrocarbon content of the fluid from a formation. For example, consider a hydrophilic spacer fluid that reduces risk of miscibility with formation fluid hydrocarbon(s) and/or natural and/or synthetic oil of an oil-base mud (e.g., drilling fluid, lubricating fluid, etc.).

As an example, a method can include suspending a tool via a cable and/or deploying a tool via a string of drillpipe, for example, where the tool is operatively coupled to a cable that runs along the string of drillpipe and where the cable includes at least one power conductor and at least one data conductor.

As an example, a method can include deploying a tool via coiled tubing, where the tool is operatively coupled to a cable that runs along the coiled tubing and where the cable includes at least one power conductor and at least one data conductor.

As an example, a method can include deploying at least one packer, deploying at least one probe, etc., where such a packer, probe, etc., is operatively coupled to a tool.

As an example, a method can include operating at least one pump that is operatively coupled to a tool (e.g., for sampling fluid, for inflating a packer, for deflating a packer, for actuating a hydraulically driven component, etc.).

As an example, a method can include separating gas from fluid at a station. In such an example, the method can include flaring at least a portion of the gas or storing at least a portion of the gas. For example, consider separating gas from sampled formation fluid where the gas and/or formation fluid may be analyzed, processed, stored, flared, burned, etc.

As an example, a method can include measuring a property of fluid using a sensor of a tool. As explained, a tool can include one or more sensors where formation fluid may be analyzed downhole using such one or more sensors.

As an example, a method can include measuring a property of fluid using a sensor of a station where such a station can be a surface station that can be utilized to collect sampled formation fluid.

As an example, a method can include flowing spacer fluid by flowing a first portion of the spacer fluid to form a first spacer and flowing a second portion of the spacer fluid to form a second spacer, where flowing the fluid and the spacer fluid in an annulus includes flowing the fluid between the first spacer and the second spacer.

As an example, a method can include flowing fluid from a formation from an inlet of a tool to an annulus by flowing a volume of the fluid into spacer fluid to divide the spacer fluid into at least two portions that form at least two corresponding spacers.

As an example, a method can include measuring a property of fluid using a sensor of a tool and, based at least in part on the property, determining a characteristic of the spacer fluid. For example, consider tailoring the density of the spacer fluid based on a density of the fluid. In such an example, the property can be one or more of a gas property, a gas-oil ratio (GOR), etc. As an example, the characteristic of the spacer fluid can be tailored to reduce risk of a kick (e.g., to compensate for "lightness" of a formation fluid sample or samples being driven to surface in an annular region, etc.).

As an example, a method can include measuring a property of fluid using a tool and, based at least in part on the property, determining an amount of fluid to flow to the annulus. For example, where formation fluid may be lighter than mud, it may reduce total weight in an annulus such that an amount of formation fluid is limited to a maximum amount that does not give rise to a risk of kick (e.g., reduce mass/weight in the annulus that creates a pressure upon a formation, etc.).

As an example, a system can include a tool operatively coupled to a cable that includes a packer, a fluid inlet, a fluid outlet, a pump, at least one power conductor and at least one data conductor; a blowout preventer that includes a bypass line coupling in fluid communication with an annulus; a bypass line attached to the bypass line coupling and in fluid communication with the annulus and a station; a spacer fluid pump in fluid communication with a conduit, where an opening of the conduit is in fluid communication with an opening of the annulus; and a system controller that includes processor-executable instructions executable by a processor to: instruct the spacer fluid pump to pump spacer fluid to the conduit, instruct the tool to flow formation fluid, where at least a portion of the spacer fluid and at least a portion of the formation fluid flow sequentially to the annulus, from the annulus to the bypass line and from the bypass line to the station, and instruct the station to collect a volume of the formation fluid.

As an example, one or more computer-readable storage media can include processor-executable instructions, executable to instruct a system to: flow fluid from a formation from an inlet of a tool to an annulus; flow spacer fluid from a conduit to the annulus; flow the fluid and the spacer fluid in the annulus to a station; and collect the fluid. As an example, a computer-program product can include instructions executable by a computing system to cause a system to perform one or more actions, for example, of one or more methods.

As an example, a method of segregating reservoir fluid from wellbore fluid (e.g., mud) in a wellbore can include positioning a downhole tool in a wellbore, where the downhole tool is conveyed by at least one of a drillpipe or wireline, and where the downhole tool includes at least one inlet port through which a reservoir fluid passes from a first point in a formation into the downhole tool, and a circulation assembly in fluid communication with the downhole tool and the drillpipe; flowing a quantity of a first spacer through the drillpipe into the circulation assembly, where the first spacer at least partially exits the circulation assembly into an annulus between the wellbore and the circulation assembly; setting the first spacer proximate the circulation assembly; flowing a quantity of formation fluid through the downhole tool and out the circulation assembly into the annulus; circulating the wellbore fluid through the drillpipe and out the circulation assembly into the annulus to displace the at least first spacer and the formation fluid. In such an example, the method can include setting the first spacer step by setting the spacer so that it covers at least a portion of the circulation assembly. In such an example, the formation can fluid exit the circulation assembly into the first spacer.

As an example, a method can include after flowing a quantity of formation fluid, flowing a quantity of a second spacer through drillpipe into a circulation assembly, where the second spacer exits the circulation assembly into an annulus between the wellbore and the circulation assembly.

As an example, a spacer can include a fluid that is immiscible with formation fluid and/or wellbore fluid (e.g., mud).

As an example, a method can include displacing a spacer, formation fluid, and wellbore fluid (e.g., mud) through a bypass line to at least one surface containment. In such an example, the method can include selectively flowing the formation fluid and the spacer into a first surface containment, and selectively flowing the wellbore fluid into a second surface containment.

As an example, one or more computer-readable storage media can include processor-executable instructions, executable to instruct a computing system to: receive sensor data acquired using one or more downhole tool pressure gauges disposed in a borehole in a geologic formation responsive to a fluid operation, where the geologic formation includes a reservoir; and, for the fluid operation, using at least an infinite acting model, determine a distance of pressure influence in the geologic formation. A computer-readable storage medium is a device that is tangible, non-transitory, not a signal and not a carrier wave. Such a device can be utilized to store instructions and/or data (e.g., one or more of sensor data, specification data, formation property data, etc.).

As an example, a computer program product can include processor-executable instructions to instruct a computing system. Such a product may be utilized by a computing device, a computing system, etc., to perform a method, for example, consider one or more of the methods described herein.

Figure 9:
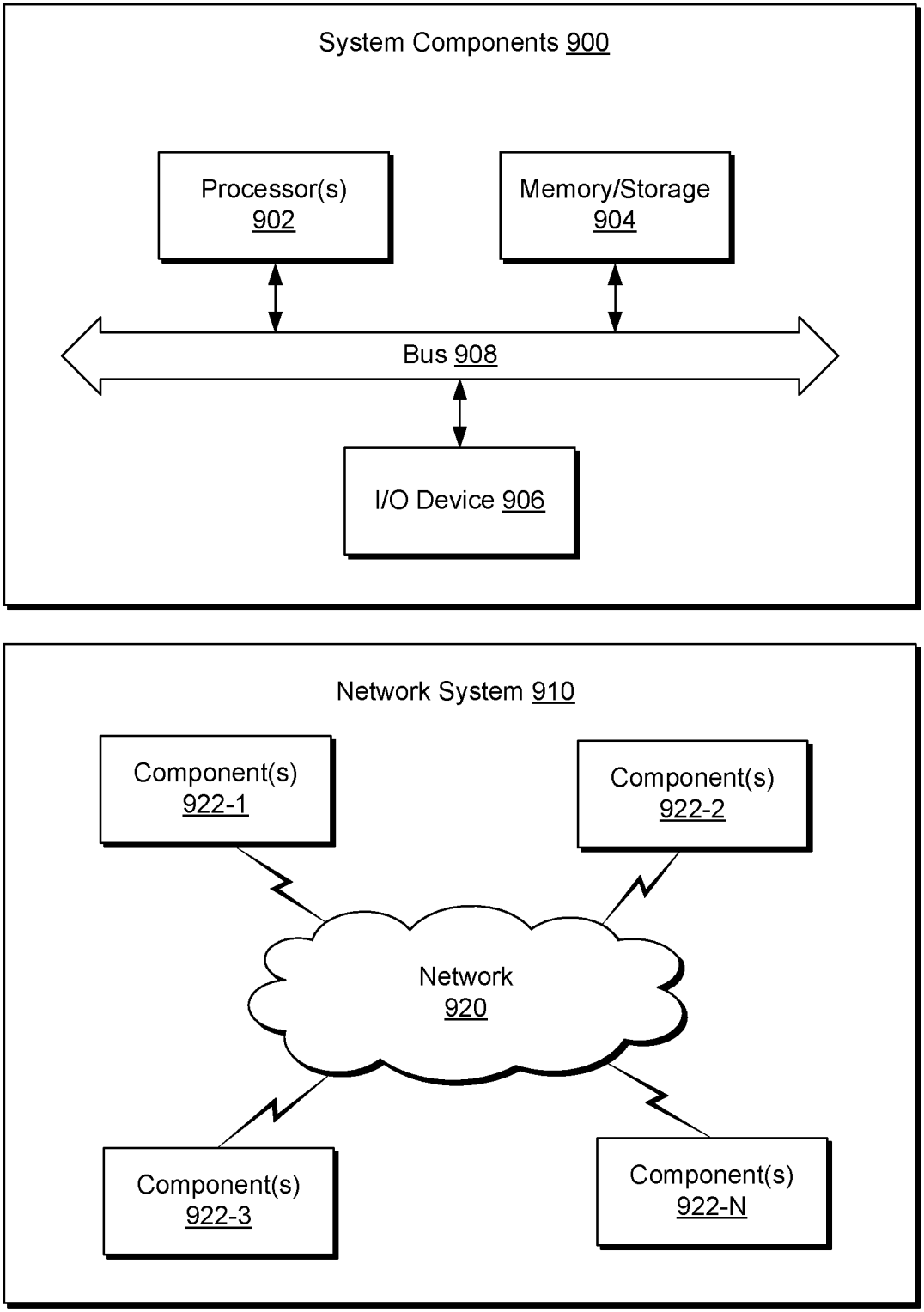
FIG. 9 illustrates an example of a system and an example of a networked system.

FIG. 9 shows components of an example of a computing system 900 and an example of a networked system 910 that includes a network 920, where the system 900 may be utilized to perform a method, to form a specialized system, etc. The system 900 includes one or more processors 902, memory and/or storage components 904, one or more input and/or output devices 906 and a bus 908. In an example embodiment, instructions may be stored in one or more computer-readable media (e.g., memory/storage components 904). Such instructions may be read by one or more processors (e.g., the processor(s) 902) via a communication bus (e.g., the bus 908), which may be wired or wireless. The one or more processors may execute such instructions to implement (wholly or in part) one or more attributes (e.g., as part of a method). A user may view output from and interact with a process via an I/O device (e.g., the device 906). In an example embodiment, a computer-readable medium may be a storage component such as a physical memory storage device, for example, a chip, a chip on a package, a memory card, etc. (e.g., a computer-readable storage medium).

In an example embodiment, components may be distributed, such as in the network system 910. The network system 910 includes components 922-1, 922-2, 922-3, . . . 922-N. For example, the components 922-1 may include the processor(s) 902 while the component(s) 922-3 may include memory accessible by the processor(s) 902. Further, the component(s) 902-2 may include an I/O device for display and optionally interaction with a method. The network 920 may be or include the Internet, an intranet, a cellular network, a satellite network, etc.

As an example, a device may be a mobile device that includes one or more network interfaces for communication of information. For example, a mobile device may include a wireless network interface (e.g., operable via IEEE 802.11, ETSI GSM, BLUETOOTH, satellite, etc.). As an example, a mobile device may include components such as a main processor, memory, a display, display graphics circuitry (e.g., optionally including touch and gesture circuitry), a SIM slot, audio/video circuitry, motion processing circuitry (e.g., accelerometer, gyroscope), wireless LAN circuitry, smart card circuitry, transmitter circuitry, GPS circuitry, and a battery. As an example, a mobile device may be configured as a cell phone, a tablet, etc. As an example, a method may be implemented (e.g., wholly or in part) using a mobile device. As an example, a system may include one or more mobile devices.

As an example, a system may be a distributed environment, for example, a so-called "cloud" environment where various devices, components, etc. interact for purposes of data storage, communications, computing, etc. As an example, a device or a system may include one or more components for communication of information via one or more of the Internet (e.g., where communication occurs via one or more Internet protocols), a cellular network, a satellite network, etc. As an example, a method may be implemented in a distributed environment (e.g., wholly or in part as a cloud-based service).

As an example, information may be input from a display (e.g., consider a touchscreen), output to a display or both. As an example, information may be output to a projector, a laser device, a printer, etc. such that the information may be viewed. As an example, information may be output stereographically or holographically. As to a printer, consider a 2D or a 3D printer. As an example, a 3D printer may include one or more substances that can be output to construct a 3D object. For example, data may be provided to a 3D printer to construct a 3D representation of a subterranean formation. As an example, layers may be constructed in 3D (e.g., horizons, etc.), geobodies constructed in 3D, etc. As an example, holes, fractures, etc., may be constructed in 3D (e.g., as positive structures, as negative structures, etc.).

Although only a few examples have been described in detail above, those skilled in the art will readily appreciate that many modifications are possible in the examples. Accordingly, all such modifications are intended to be included within the scope of this disclosure as defined in the following claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures.

What is claimed is:

1. A method comprising:

flowing fluid from a formation from an inlet of a tool to an annulus;

flowing spacer fluid from a conduit to the annulus by flowing a first portion of the spacer fluid to form a first spacer and flowing a second portion of the spacer fluid to form a second spacer;

flowing the fluid and the spacer fluid in the annulus to a station by flowing the fluid between the first spacer and the second spacer; and collecting the fluid.

2. The method of claim 1, wherein the spacer fluid is formulated to reduce miscibility with hydrocarbon content of the fluid from the formation.

3. The method of claim 1, wherein flowing the fluid and the spacer fluid in the annulus to the station comprises utilizing a bypass line that bypasses a portion of the annulus that extends to a rig platform.

4. The method of claim 3, wherein the bypass line is in fluid communication with a blowout preventer.

5. The method of claim 1, comprising suspending the tool via a cable.

6. The method of claim 1, comprising deploying the tool via a string of drillpipe, wherein the tool is operatively coupled to a cable that runs along the string of drillpipe, wherein the cable comprises at least one power conductor and at least one data conductor.

7. The method of claim 1, comprising deploying the tool via coiled tubing, wherein the tool is operatively coupled to a cable that runs along the coiled tubing, wherein the cable comprises at least one power conductor and at least one data conductor.

8. The method of claim 1, comprising deploying at least one packer that is operatively coupled to the tool.

9. The method of claim 1, comprising operating at least one pump that is operatively coupled to the tool.

10. The method of claim 1, comprising separating gas from the fluid at the station.

11. The method of claim 1, comprising measuring a property of the fluid using a sensor of the tool.

12. The method of claim 1, comprising measuring a property of the fluid using a sensor of the station.

13. The method of claim 1, wherein flowing fluid from the formation from the inlet of the tool to the annulus comprises flowing a volume of the fluid into the spacer fluid to divide the spacer fluid into at least two portions that form at least two corresponding spacers.

14. The method of claim 1, comprising measuring a property of the fluid using a sensor of the tool and, based at least in part on the property, determining a characteristic of the spacer fluid.

15. The method of claim 14, wherein the property comprises a gas property.

16. The method of claim 14, wherein the characteristic of the spacer fluid reduces risk of a kick.

17. The method of claim 1, comprising measuring a property of the fluid using the tool and, based at least in part on the property, determining an amount of the fluid to flow to the annulus.

18. A system comprising:

a tool operatively coupled to a cable that comprises a packer, a fluid inlet, a fluid outlet, a pump, at least one power conductor and at least one data conductor;

a blowout preventer that comprises a bypass line coupling in fluid communication with an annulus;

a bypass line attached to the bypass line coupling and in fluid communication with the annulus and a station;

a spacer fluid pump in fluid communication with a conduit, wherein an opening of the conduit is in fluid communication with an opening of the annulus; and a system controller that comprises processor-executable instructions executable by a processor to:

instruct the spacer fluid pump to pump spacer fluid to the conduit, instruct the tool to flow formation fluid, wherein at least a portion of the spacer fluid and at least a portion of the formation fluid flow sequentially to the annulus, from the annulus to the bypass line and from the bypass line to the station, and instruct the station to collect a volume of the formation fluid.

19. One or more computer-readable storage media comprising processor-executable instructions, executable to instruct a system to:

flow fluid from a formation from an inlet of a tool to an annulus;

flow a first portion of a spacer fluid from a conduit to the annulus;

flow a second portion of the spacer fluid from the conduit to the annulus;

flow the fluid between the first and second portions of the spacer fluid in the annulus to a station; and collect the fluid.

20. A method comprising:

flowing a spacer fluid from a conduit to an annulus;

flowing a formation fluid from an inlet of a tool into the spacer fluid in the annulus and dividing the spacer fluid into at least two portions that form at least two corresponding spacers;

flowing the formation fluid and the spacer fluid portions in the annulus to a station; and collecting the formation fluid.

* * * * *